US005738030A

United States Patent [19]

Ok

[11] Patent Number: 5,738,030

[45] Date of Patent: Apr. 14, 1998

[54] PATTERN METHOD FOR MULTICOLOR DESIGNS

[75] Inventor: Thol Ok, Chattanooga, Tenn.

[73] Assignee: General Design, Inc. Rossville, Ga.

[21] Appl. No.: 614,295

[22] Filed: Mar. 11, 1996

[51] Int. Cl.[6] ..... D05C 15/26; D05C 15/30

[52] U.S. Cl. ..... 112/475.23; 112/80.23; 112/80.08; 112/80.41

[58] Field of Search ..... 112/80.01, 80.23, 112/80.4, 80.41, 80.43, 80.44, 102.5, 80.16, 80.31, 80.7, 80.08, 475.23

[56] References Cited

U.S. PATENT DOCUMENTS

| | | | |
|---|---|---|---|
| 3,595,185 | 7/1971 | Shorrock | 112/80.08 |
| 3,756,173 | 9/1973 | Shorrock | 112/80.08 |
| 4,549,496 | 10/1985 | Kile | 112/80.16 |
| 4,991,523 | 2/1991 | Ingram | 112/80.16 |
| 5,080,028 | 1/1992 | Ingram | 112/80.16 |
| 5,165,352 | 11/1992 | Ingram | 112/80.16 |
| 5,392,723 | 2/1995 | Kaju | 112/80.23 |
| 5,588,383 | 12/1996 | Davis et al. | 112/80.16 |

*Primary Examiner*—Paul C. Lewis
*Attorney, Agent, or Firm*—Martin L. McGregor

[57] ABSTRACT

The present invention provides a method for use in a machine for placing a plurality of colors of threads into a backing web to form a desired pattern having (a) a plurality of thread placement tools for placing a selected thread color from a plurality of thread color supply sources into the backing web; (b) a control means responsive to an instruction set for carrying out sequential operations to produce a desired pattern; (c) means for accurately relatively positioning the thread placement tools relative to the backing web in response to commands from said control means and (d) means for selective placement of said thread colors into said backing web in response to commands from said control means, an improved method for placing said thread colors into said backing web to form said desired pattern comprising the steps of:

supplying at least two thread colors to a first thread placement tool and supplying at least one color different from the colors supplied to the first thread placement tool to a second thread placement tool, each of said first and second placement tools being positionable relative to an overlapping region of said backing web and being supplied fewer than the total number of colors to be used within the overlapping region of the backing web;

relatively positioning said first tool at a selected location with respect to said backing web and within said overlapping region in response to commands from said control means;

placing said selected one or more thread colors into said backing web at said selected location in response to commands from said control means;

relatively positioning said second tool with respect to said backing web over a selected location on said backing web within the overlapping region which requires a thread color available from said second tool but not said first tool; and placing selected one or more of the thread colors supplied to said second thread placement tool into said backing web at said selected location in said overlapping region in response to commands from said control means. The invention also provides apparatus specially adapted to practice the method and an instruction set for carrying out the method.

18 Claims, 12 Drawing Sheets

26
28
28
30
10
Y1
Y1
Y2
Y2
Y3
Y3
Y4
Y4
Y5
Y5
C
22
22
H
H
64
64
14
14
18
16
38
38
12
20
B
B

220
CONTROL SYSTEM
BACKING ADVANCE DRIVE SYSTEM
HEAD TRAVERSE DRIVE SYSTEM
HEAD RECIPROCATE DRIVE SYSTEM
YARN SELECTOR & FEEDING

THREADING SEQUENCE FOR THREE COLOR NEEDLE WITH THREE COLOR PATTERN

THREADING SEQUENCE FOR THREE COLOR NEEDLE WITH FOUR COLOR PATTERN

THREADING SEQUENCE FOR THREE COLOR NEEDLE WITH FIVE COLOR PATTERN

THREADING SEQUENCE FOR THREE COLOR NEEDLE WITH SIX COLOR PATTERN

THREADING SEQUENCE FOR THREE COLOR NEEDLE WITH SEVEN COLOR PATTERN

A A A A A A A A A A A A A A A A
B B B B B B B B B B B B B B B B

THREADING SEQUENCE FOR TWO COLOR NEEDLE WITH TWO COLOR PATTERN

Fig. 12A

A C B A C B A C B A C B A C B A
B A C B A C B A C B A C B A C B

THREADING SEQUENCE FOR TWO COLOR NEEDLE WITH THREE COLOR PATTERN

Fig. 12B

A C A C A C A C A C A C A C A C
B D B D B D B D B D B D B D B D

THREADING SEQUENCE FOR TWO COLOR NEEDLE WITH FOUR COLOR PATTERN

Fig. 12C

A C E B D A C E B D A C E B D A
B D A C E B D A C E B D A C E B

THREADING SEQUENCE FOR TWO COLOR NEEDLE WITH FIVE COLOR PATTERN

Fig. 12D

A C E A C E A C E A C E A C E A
B D F B D F B D F B D F B D F B

THREADING SEQUENCE FOR TWO COLOR NEEDLE WITH SIX COLOR PATTERN

Fig. 12E

A C E G B D F A C E G B D F A C
B D F A C E G B D F A C E G B D

THREADING SEQUENCE FOR TWO COLOR NEEDLE WITH SEVEN COLOR PATTERN

Fig. 12F

| | | | | | | | | | | | | | |
|---|---|---|---|---|---|---|---|---|---|---|---|---|---|
| | A | B | C | B | A | B | C | B | A | B | C | B | |
| | B | A | B | A | B | A | B | A | B | A | B | A | |
| | C | B | A | B | C | B | A | B | C | B | A | B | |
| | B | A | B | A | B | A | B | A | B | A | B | A | |
| | A | B | C | B | A | B | C | B | A | B | C | B | |

Fig. 14

| | | | | | | | | | | | | | |
|---|---|---|---|---|---|---|---|---|---|---|---|---|---|
| | A | B | C | B | A | B | C | B | A | B | C | B | |
| A | C | | | B | | | A | | | C | | | |
| B | A | | | C | | | B | | | A | | | |
| | A | | | B | | | | | | | | | |
| | A | | | B | | | | | | | | | |

Fig. 15A

| | | | | | | | | | | | | | |
|---|---|---|---|---|---|---|---|---|---|---|---|---|---|
| | A | B | C | B | A | B | C | B | A | B | C | B | |
| A | | C | | | B | | | A | | | C | | |
| B | | A | | | C | | | B | | | A | | |
| | | | | | | | | B | | | C | | |
| | A | | | B | | | | B | | | C | | |

Fig. 15B

| | | | | | | | | | | | | | |
|---|---|---|---|---|---|---|---|---|---|---|---|---|---|
| | A | B | C | B | A | B | C | B | A | B | C | B | |
| A | | | C | | | B | | | A | | | C | |
| B | | | A | | | C | | | B | | | A | |
| | | | C | | | B | | | A | | | | |
| | A | | C | B | | B | | B | A | | C | | |

Fig. 15C

PATTERN METHOD FOR MULTICOLOR DESIGNS

TECHNICAL FIELD

This invention relates generally to methods and machines for production of multicolor designs in tufted goods such as carpet and the like, more particularly, to a novel method of thread selection and placement in a tufting machine for producing multicolor designs or multi texture patterns on a backing material.

BACKGROUND OF THE INVENTION

The realization of practical apparatus and methods capable of producing patterned tufted goods using multicolored or multi textured threads represents, perhaps, the single greatest unsatisfied need of the tufting industry. No other need has received more time or attention, and despite the numerous proposals which have been advanced for tufting styling techniques that are capable of competing with the styling ability of a loom, none has proved to be satisfactory or commercially practical. At present, the only sources of such patterned goods are woven goods produced by a loom, those produced using various tinting or dyeing techniques, or those produced by the hollow needle tufting apparatus described in U.S. Pat. No. 4,549,496 and improvements thereof.

In order to produce tufted goods embodying patterns or designs using threads of different colors or different textures, it is necessary to be able to select from a plurality of different threads the particular thread or threads that are to be implanted in a backing for each tuft. In a conventional multi needle broadloom tufting machine, a large number, 1200, for example, of needles are connected in a reciprocating needle bar, and each needle is threaded with thread supplied from a corresponding spool located in a thread creel. To produce a multicolored or multi textured pattern with such machines requires the ability to change the thread supplied to each needle for each needle stroke. This is not possible in a conventional tufting machine. Although other types of tufting machines have been proposed wherein the tufting needles are threaded each stroke with a precut length of thread that may be selected from a plurality of different threads, such machines are complex and have proved to be impractical. Other proposals have included modifying conventional machines to provide tandem groups of needles, each needle of a group being supplied with one of the different threads, and either a needle selection mechanism for selecting the particular needle of a group that is actuated during each stroke, or a thread feeding mechanism for controlling the amount of thread supplied to each needle so as to produce either a low pile for non-selected threads that is obscured by a higher pile of the selected threads, or for causing the non-selected threads that are implanted to be pulled from the backing by their corresponding needles during the next needle stroke. These approaches also have proved to be complex and impractical or otherwise unsatisfactory. The hollow needle machines are a significant improvement over the earlier attempts at production of multicolor designs but such machines are still significantly slower than conventional tufting machines.

Improvements on the basic machine described in U.S. Pat. No. 4,549,496 include transverse shifting of the backing material as described in U.S. Pat. No. 4,991,523, thread pullback as described in U.S. Pat. No. 5,080,028, and improved feed as described in U.S. Pat. No. 5,165,352. These basic and improved machines are collectively referred to below as hollow needle machines, which should be understood to include a basic machine or one including one or more of improvements. Other improvements in technology include improved computer control systems due to the availability of faster and more powerful computers, allowing more detailed control and response. The improved shifting mechanism of co-pending application Ser. No. 08/541,482, assigned to the assignee of the present invention, adds additional flexibility in machine design. However, conventional operation of this equipment has been limited in production due to its relatively slow speed and corresponding high production costs of finished goods.

A significant factor in conventional operation of hollow needle machines influencing the production speed is the number of tufting heads used in the apparatus. In the conventional machine, each color of thread requires a separate thread exchange means supplying each color to each head. Thus, to increase the number of colors in a pattern, an additional thread exchange and thread supply must be provided at each thread placement tool or needle. This design feature has limited the number of colors used in commercial machines to six or less. As the number of colors supplied at each thread placement tool increases, so also do the physical size and weight of the thread placement tool head and thread exchange mechanisms increase. The size of the thread placement tool head makes it impractical to place the heads closer than about two inches apart. The conventional machine places a set of threads, the backing traverses one increment depending on the desired thread placement density, the appropriate color for the next position is provided at each thread placement tool location by thread exchange, the next threads are placed in the backing and the traverse is repeated with selection placement and traverse steps continuing until the backing (or thread placement tools) have traversed the distance between placement tools. The backing then advances an increment and the thread placement, thread selection and traverse steps are repeated with the direction of traverse reversing, and so on until the desired length of goods is completed. When more than a few colors are used, the weight of the thread placement tool heads required increases to the point that it is much preferred to shift the backing. However backing shifting is naturally limited by the great weight of the backing, rollers and transport mechanisms that must also be shifted. Increases in the number of thread placement tool positions, reduction in weight and complexity of the thread tool placement heads and decreases in the total distance for shifting are well-known means to increasing the production speed of the tufting machinery. However, heretofore, the art has not produced a practical method for producing more than six color patterns, nor for increasing the number of thread placement heads and reducing the total shift distance required for complete traverse between locations.

It is desirable to provide apparatus and methods for more rapidly providing patterned tufted goods from threads of different colors or textures that avoid the foregoing disadvantages, and it is to this end that the present invention is directed.

SUMMARY OF THE INVENTION

As used here, thread placement tools should be understood to include any means for placing a thread in a backing material, including needles, used with or without loopers or cutters, hollow needles, or tubular backing openers, with or without cutters, loopers or shears, and the like. As used here, thread should be understood to mean a strand of fiber, twisted or untwisted, monofilament or multi filament, and also includes fibers commonly referred to as yarn. As used here, a "different color" means any noticeable difference between threads, and may include threads of the same hue but different size, or texture, as well those absorbing or reflecting light of a different wavelength.

Objects of the present inventions are to decrease the distance between thread placement tools, increase the flexibility of operation, reduce the number of thread supply sources provided for each thread exchange means within each thread placement tool head, increase the operational speed in producing patterns of six or fewer colors, and increase the number of colors available for designs. These and other objects are accomplished by a method of operation wherein the number of colors to each needle is reduced so that less than the total number of colors is available at each thread placement tool. Thread colors not available at the first thread placement tool are available at a second or third thread placement tool. Threads colors needed for a pattern which are available at the desired location are placed into the backing on the first backing piercing stroke of the thread placement tool, as in conventional tufting. Thread placement tools that do not have a correct color for the position place no threads on this first stroke. Prior to the second backing piercing stroke, the thread placement tools are relocated to bring a second thread placement tool to supply desired colors at locations where no threads were placed on the first stroke. Again no threads are left by tools with incorrect colors in locations for the desired pattern and at locations that have already received a thread on a previous stroke. The transverse shift distance is adjusted such that the thread placement tools in the second stroke locations just miss the threads inserted into the backing on the first stroke. This combination of shifting and thread placement is repeated until all desired colors are supplied to all locations. The thread placement tools are then shifted over by a selected increment and the placement of colors at the second location proceeds by repeating the sequence of steps as described for the first location. The steps are repeated until the space corresponding to the distance between thread placement tools is filled to the desired density with threads. The backing is then advanced and a new row of threads is placed. The disclosed improvement in thread placement over the conventional six thread commercial machine is that thread placement tools with two or three colors per tool can be built which are much thinner and can be configured to be placed much closer together than the currently used hollow needle machine heads. The current machines place needle heads on approximately two inch (5.08 cm) or two and a half inch (6.35 cm) centers. By supplying only two colors to each position, thin heads may be placed much closer, for example on half inch (1.27 cm) centers. By using the threading sequences illustrated below and shifting to supply colors at desired locations, six colors can be supplied to any position with one left and one right shift from any starting position. Because of the four fold increase in the number of needles and four fold decrease in the space between needles, the time required by the multiple strokes to place colors is more than regained by net increase in placement of threads on each stroke. Alternatively 12, 18 or any other number of color designs can be made with six color conventional heads, using the threading sequence logic and thread placement steps described above.

The present invention thus provides in a machine for placing a plurality of colors of threads into a backing web to form a desired pattern having (a) a plurality of thread placement tools for placing a selected thread color from a plurality of thread color supply sources into the backing web; (b) a control means responsive to an instruction set for carrying out sequential operations to produce a desired pattern; (c) means for accurately relatively positioning the thread placement tools relative to the backing web in response to commands from said control means and (d) means for selective placement of said thread colors into said backing web in response to commands from said control means, an improved method for placing said thread colors into said backing web to form said desired pattern comprising the steps of:

supplying at least two thread colors to a fast thread placement tool and supplying at least one color different from the colors supplied to the first thread placement tool to a second thread placement tool, each of said first and second placement tools being positionable relative to an overlapping region of said backing web and being supplied fewer than the total number of colors to be used within the overlapping region of the backing web;

relatively positioning said first tool at a selected location with respect to said backing web and within said overlapping region in response to commands from said control means;

placing said selected one or more thread colors into said backing web at said selected location in response to commands from said control means;

relatively positioning said second tool with respect to said backing web over a selected location on said backing web within the overlapping region which requires a thread color available from said second tool but not said first tool; and placing selected one or more of the thread colors supplied to said second thread placement tool into said backing web at said selected location in said overlapping region in response to commands from said control means. In preferred embodiments, the thread placement tool may be a tubular backing opener, the thread ends may be pneumatically conveyed from a thread end supply source to the thread placement tool, or the means for changing the relative positions of the thread placement tools in relationship to the backing web may include means for moving the backing web in a transverse direction relative to the thread placement tools, all as described, for example, in U.S. Pat. No. 4,991,523. In an alternative embodiment, the means for changing the relative positions of the thread placement tools in relationship to the backing web includes means for moving the thread placement tools in a transverse direction relative to the backing web as described, for example, in U.S. Pat. No. 4,549,496. Another preferred embodiment includes a thread end supply source which includes a thread pull back means as described, for example, in U.S. Pat. No. 5,080,028. In an especially preferred embodiment, each thread placement tool is supplied three thread ends. Another especially preferred embodiment provides each thread placement tool with three thread ends. The relative distance between thread placement tools and number of shifts required for complete availability of all colors at each particular location may be determined from table 1 or table 2 below for threading sequences up to seven colors for two or three thread systems. It should be recognized that the method of the invention can be expanded to handle any number of thread supplies and colors. As a practical matter, however, the smaller thread supply systems with modest numbers of colors will provide high speed operation and increased production, while using more colors will involve either more shifting or more supplies per thread placement tool, ultimately resulting in lower speeds of operation.

SHIFT TABLE 1

TWO COLOR NEEDLE-½ INCH CENTER

| Color | # Unit Distance Between Needles | Total Shift | Totals Gauge | Current CYP shifts | Increase |
|---|---|---|---|---|---|
| 2 | 0 | 0 | ½ | | |
| 2 | 1 | 1 | ¼ | | |
| 2 | 2 | 2 | ⅙ | | |
| 2 | 3 | 3 | ⅛ | | |
| 2 | 4 | 4 | 1/10 | 20 | 400% |
| 2 | 5 | 5 | 1/12 | 24 | 380% |
| 3 | 0 | 1 | ½ | | |
| 3 | 1 | 3 | ¼ | | |
| 3 | 2 | 5 | ⅙ | | |
| 3 | 3 | 7 | ⅛ | | |
| 3 | 4 | 9 | 1/10 | 20 | 122% |
| 3 | 5 | 11 | 1/12 | 24 | 122% |
| 4 | 0 | 1 | ½ | | |
| 4 | 1 | 3 | ¼ | | |
| 4 | 2 | 5 | ⅙ | | |
| 4 | 3 | 7 | ⅛ | | |
| 4 | 4 | 9 | 1/10 | 20 | 122% |
| 4 | 5 | 11 | 1/12 | 24 | 118% |
| 5 | 0 | 2 | ½ | | |
| 5 | 1 | 5 | ¼ | | |
| 5 | 2 | 8 | ⅙ | | |
| 5 | 3 | 11 | ⅛ | | |
| 5 | 4 | 14 | 1/10 | 20 | 42% |
| 5 | 5 | 17 | 1/12 | 24 | 41% |
| 6 | 0 | 2 | ½ | | |
| 6 | 1 | 5 | ¼ | | |
| 6 | 2 | 8 | ⅙ | | |
| 6 | 3 | 11 | ⅛ | | |
| 6 | 4 | 14 | 1/10 | 20 | 42% |
| 6 | 5 | 17 | 1/12 | 24 | 41% |

SHIFT TABLE 2

THREE COLOR NEEDLE-½ INCH CENTER

| # Colors | # Unit Distance Between Needles | Total Shifts | Total Gauge | Current CYPshiil | Increase |
|---|---|---|---|---|---|
| 2 | 0 | 0 | ½ | | |
| 2 | 1 | 1 | ¼ | | |
| 2 | 2 | 2 | ⅙ | | |
| 2 | 3 | 3 | ⅛ | | |
| 2 | 4 | 4 | 1/10 | 20 | 400% |
| 2 | 5 | 5 | 1/12 | 24 | 380% |
| 3 | 0 | 0 | ½ | | |
| 3 | 1 | 1 | ¼ | | |
| 3 | 2 | 2 | ⅙ | | |
| 3 | 3 | 3 | ⅛ | | |
| 3 | 4 | 4 | 1/10 | 20 | 400% |
| 3 | 5 | 5 | 1/12 | 24 | 380% |
| 4 | 0 | 1 | ½ | | |
| 4 | 1 | 3 | ¼ | | |
| 4 | 2 | 5 | ⅙ | | |
| 4 | 3 | 7 | ⅛ | | |
| 4 | 4 | 9 | 1/10 | 2 | 122% |
| 4 | 5 | 11 | 1/12 | 24 | 118% |
| 5 | 0 | 0 | 1/12 | | |
| 5 | 1 | 3 | ¼ | | |
| 5 | 2 | 5 | ⅙ | | |
| 5 | 3 | 7 | ⅛ | | |
| 5 | 4 | 9 | 1/10 | 20 | 122% |
| 5 | 5 | 11 | 1/12 | 24 | 118% |
| 6 | 0 | 1 | ½ | | |
| 6 | 1 | 3 | ¼ | | |
| 6 | 2 | 5 | ⅙ | | |
| 6 | 3 | 7 | ⅛ | | |

SHIFT TABLE 2-continued

THREE COLOR NEEDLE-½ INCH CENTER

| # Colors | # Unit Distance Between Needles | Total Shifts | Total Gauge | Current CYPshiil | Increase |
|---|---|---|---|---|---|
| 6 | 4 | 9 | 1/10 | 20 | 122% |
| 6 | 5 | 11 | 1/12 | 24 | 118% |

The invention also provides apparatus for practicing the new method in the form of a machine for producing a pattern on a backing web comprising: (1)(a) a plurality of thread placement tools, each capable of placing a selected thread end from a plurality of thread end supply sources into the backing web, (b) a control means responsive to an instruction set for carrying out sequential operations to produce a desired pattern (c) means for accurately positioning the thread placement tools relative to the backing; and (d) means for changing the relative positions of the thread placement tools in relationship to the backing web to place threads at multiple relative locations on the backing web; (2) means for supplying an instruction set to produce a multicolor pattern requiring at least three different colors, to be produced, (3) a threading sequence to supply at least two thread end colors to a first thread placement tool and supplying at least one thread end color different from the colors supplied to the first thread placement tool to a second thread placement tool, (4) the thread placement tool spacing being established by the instruction set, and means for implementing transverse position shifts to produce the desired pattern by placing the selected thread color ends to be supplied to each thread placement tool such that each thread placement tool is supplied fewer than the total number of colors to be used in the pattern and the pattern is completed by shifting thread placement tool locations to supply additional colors to complete the selected pattern when a selected color is not available at a particular location in a first thread tool placement position and the unavailable desired thread color is available at a second thread placement tool position which is shifted to supply the desired thread at the particular location and the second thread placement tool selectively supplies the desired color. In preferred embodiments, the thread placement tool is a tubular backing opener, or the thread ends are pneumatically conveyed from the thread end supply source to the thread placement tool, or the means for changing the relative positions of the thread placement tools in relationship to the backing web includes means for moving the backing web in a transverse direction relative to the thread placement tools, all as described, for example, in U.S. Pat. No. 4,991,523. In an alternative embodiment, the means for changing the relative positions of the thread placement tools in relationship to the backing web includes means for moving the thread placement tools in a transverse direction relative to the backing web as described, for example, in U.S. Pat. No. 4,549,496. Another preferred embodiment includes a thread end supply source which includes a thread pull back means as described, for example, in U.S. Pat. No. 5,080,028. In an especially preferred embodiment, each thread placement tool is supplied two thread ends. Another especially preferred embodiment provides each thread placement tool with three thread ends.

In another embodiment, the method of the invention produces articles of manufacture. The instruction set which enables the machine to carry out the novel method is another alternative embodiment of the invention claimed herein. The article of manufacture and the instruction set may be used with any combination of the preferred features as described above, or other means accomplishing the same or similar functions.

The instruction set for practicing the method may be a program for a general purpose, computer adapted to provide signals to the apparatus causing specific functional responses of the apparatus to carry out the steps of the method. The instruction set embodying the invention may be assembled from known control signal instruction programs for currently available control system packages such as that available from General Design, Inc. of Rossville, Ga., or Tapistron International Inc. of Ringgold, Ga. The instruction set may also be provided by a special purpose control system, embodied in a circuit, stored in an erasable, programmable read only memory chip (EPROM), embodied in a storage medium or supplied by a punch card or other electronic or mechanical instruction system. The preferred instruction set is programmed in the C++ programming language, on an industry standard micro-computer, preferably having a Pentium type processor, 32 megabytes of random access memory and a fixed drive having 500 megabytes storage capacity. A typical instruction set is described in detail below.

An especially preferred apparatus to be adapted for practicing the invention described herein is the improved hollow needle machine as currently manufactured by Tapistron International, Inc. of Ringgold, Ga., modified as described below. However, it should be recognized that the invention can also be practiced with other machines wherein more than one thread color is supplied at a thread placement tool location as, for example, the machines wherein multiple needles each carrying a different color thread are interchanged at a single location to provide a multicolor design capability. Hollow needle machines of other manufacturers, such as those described in U.S. Pat. No. 4,254,718, may also be adapted to practice the invention. Although the invention is described in detail below and illustrated with reference to the basic hollow needle machine, the invention is not limited to any particular machine, and any machine that can perform the steps may be used to practice the method, or the apparatus embodying the invention may be built in a totally new machine having the required features as disclosed herein. Another especially preferred embodiment uses the roller and belt shifting mechanism of our co-pending application Ser. No. 08/289,704, filed of even date herewith, and used to shift either the needle bar, the backing or both.

DESCRIPTION OF THE DRAWINGS

For a more complete understanding of the present invention and the advantages thereof, reference is made to the following descriptions taken in conjunction with the accompanying drawings, in which:

FIGS. 12*a* through 12*f* illustrate threading sequences for two colors supplied to each thread placement tool.

FIG. 14 is a sample pattern.

FIGS. 15*a* through 15*g* illustrate thread placements in practicing the method of the invention to produce the pattern of FIG. 14.

DETAILED DESCRIPTION OF THE INVENTION

The following explicit embodiments are intended to illustrate and describe specific embodiments of the invention, and not to narrow or circumscribe the invention as claimed.

Many alternatives will be suggested to those skilled in the art without departing from the spirit and scope of the invention as described herein.

Apparatus

Figure 1:
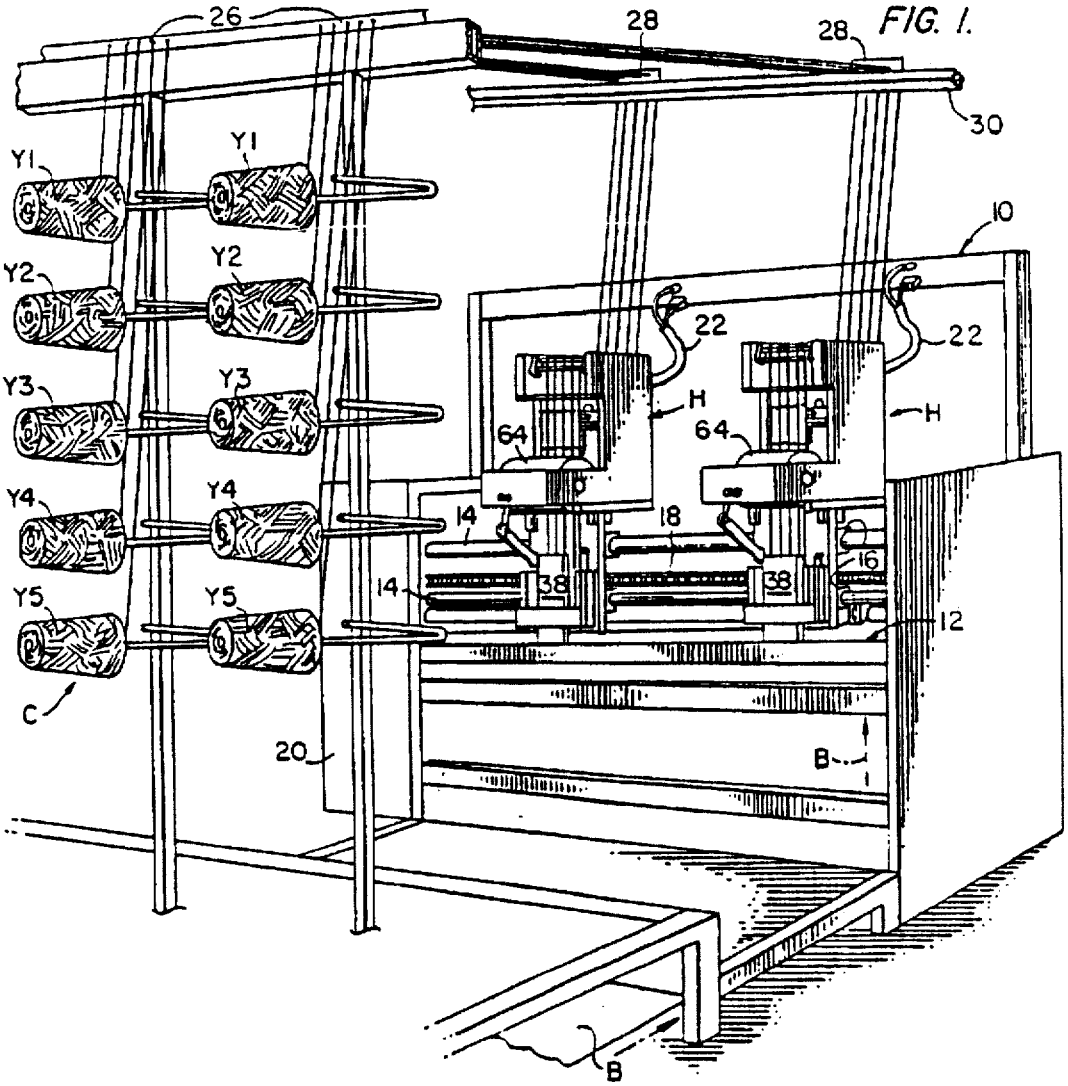
FIG. 1 is a perspective view of preferred prior art apparatus which may be adapted for practicing the invention.

A preferred embodiment of the invention provides apparatus having the following features. FIG. 1 is a perspective view of a preferred prior art apparatus which is modified in accordance with the invention for producing patterned tufted goods such as carpet and the like from a plurality of different threads. As noted above, the threads may differ in color, size, character and type, and may be heatset or non-heatset, or even staple and filament, in any combination, and any such difference should be understood to be included as a difference in color as used herein. For purposes of illustration, the embodiment of the invention described herein has the capability of using up to five (5) different threads. However, as will be appreciated, a greater or a lesser number of threads may also be employed. The currently commercial improved version of the apparatus uses up to six (6) different threads. In preferred embodiments of the present invention, two and three thread head assemblies are described in detail below for use in the basic apparatus.

As shown in FIG. 1, and as will be described in more detail hereinafter, the apparatus may generally comprise a frame-like structure 10 having a horizontal bed or work-applying region 12 past which a web of primary backing material B, as of natural or synthetic fibers, is advanced. A plurality of transversely moveable head assemblies H (only two being illustrated in FIG. 1) may be supported on the frame at region 12 for transverse movement with respect to the direction of advancement of the backing, as by a pair of fixed elongated rod-like supports 14 extending the width of the bed and corresponding low friction linear beatings 16. The head assemblies may be connected to a head traverse drive system comprising, for example, a drive chain 18 which is driven by an electric, pneumatic, or hydraulic indexing system (not illustrated) housed in an enclosure 20 disposed at one side of the apparatus for moving the plurality of head assemblies in synchronism transversely across the primary backing. Each head assembly is a self-contained unit which receives all of the plurality of the different threads Y1–Y5 that are to be used in producing the patterned goods, and, in response to control signals supplied to the head assembly via a cable 22 as the head assembly traverses the primary backing, selects the particular threads or thread combinations to be implanted at each location and implants the selected threads or thread combinations into the primary backing. As shown, the threads are supplied in continuous lengths to each head assembly from individual spools or packages of the different threads located in a thread or yarn creel C. A selected set of spools of the different threads is associated with each head assembly, in contrast with a conventional machine wherein a complete set of threads is supplied to each head assembly. The threads from the spools are guided to the head assemblies by fixed thread guides 26 and 28 located, respectively, at the creel and on a frame member 30 adjacent to the head assemblies.

For the unmodified prior art apparatus as illustrated in FIG. 1 the two head assemblies are preferably spaced apart one-half the width of the primary backing. Each head assembly traverses a distance equal to one-half the width so that together the two head assemblies implant a complete transverse row of thread tufts in the primary backing, the left-hand head assembly covering the left half of the primary backing and the right-hand head assembly covering the right half. Although only two head assemblies are illustrated in FIG. 1, in preferred form, the apparatus may employ a larger number of head assemblies (which is advantageous for increasing production speed), in which case the spacing between adjacent head assemblies and the distance each traverses would be adjusted accordingly such that the entire width of the primary backing would be traversed. For a fifteen foot wide primary backing, for example, the apparatus may employ 23 head assemblies spaced approximately eight inches apart, each traversing approximately an eight inch segment of the total width. In improved versions of this apparatus, a larger number of thread placement assemblies are spaced at two inch intervals, each capable of supplying up to six different colors. In this preferred embodiment, the large number of heads is possible because the backing rather than the head assemblies traverses, as described below. In preferred embodiments according to the invention herein, the spacing may be reduced to one half inch and a large increase in the number of heads is possible because smaller heads can be used to place an equal number of threads. The traverse of the backing is described more fully in regard to FIG. 8 below.

Figure 2:
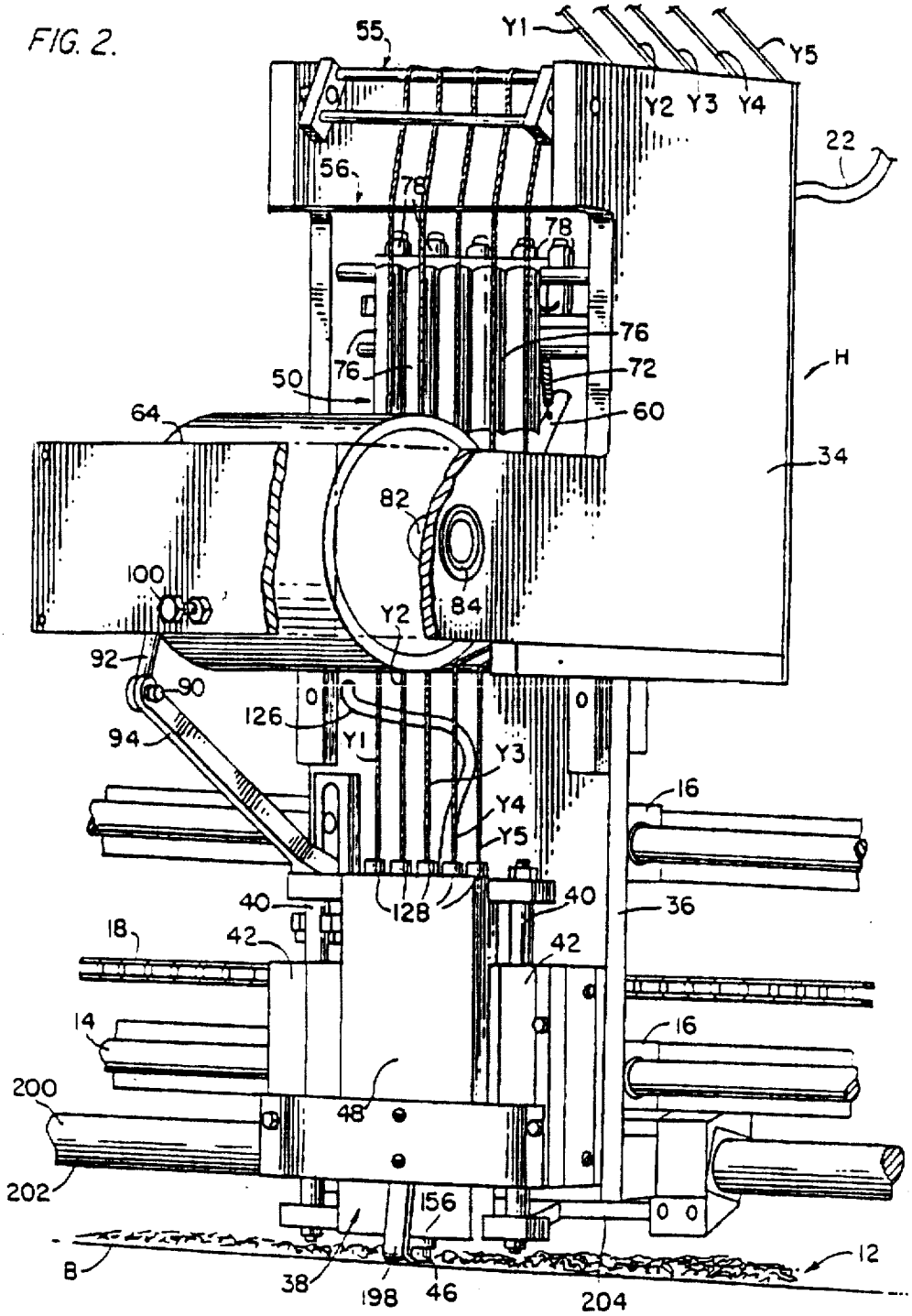
FIG. 2 is a perspective view, partially broken away, of a head assembly of the prior art apparatus of FIG. 1.
Figures 3, 6A, 6B, 6C:
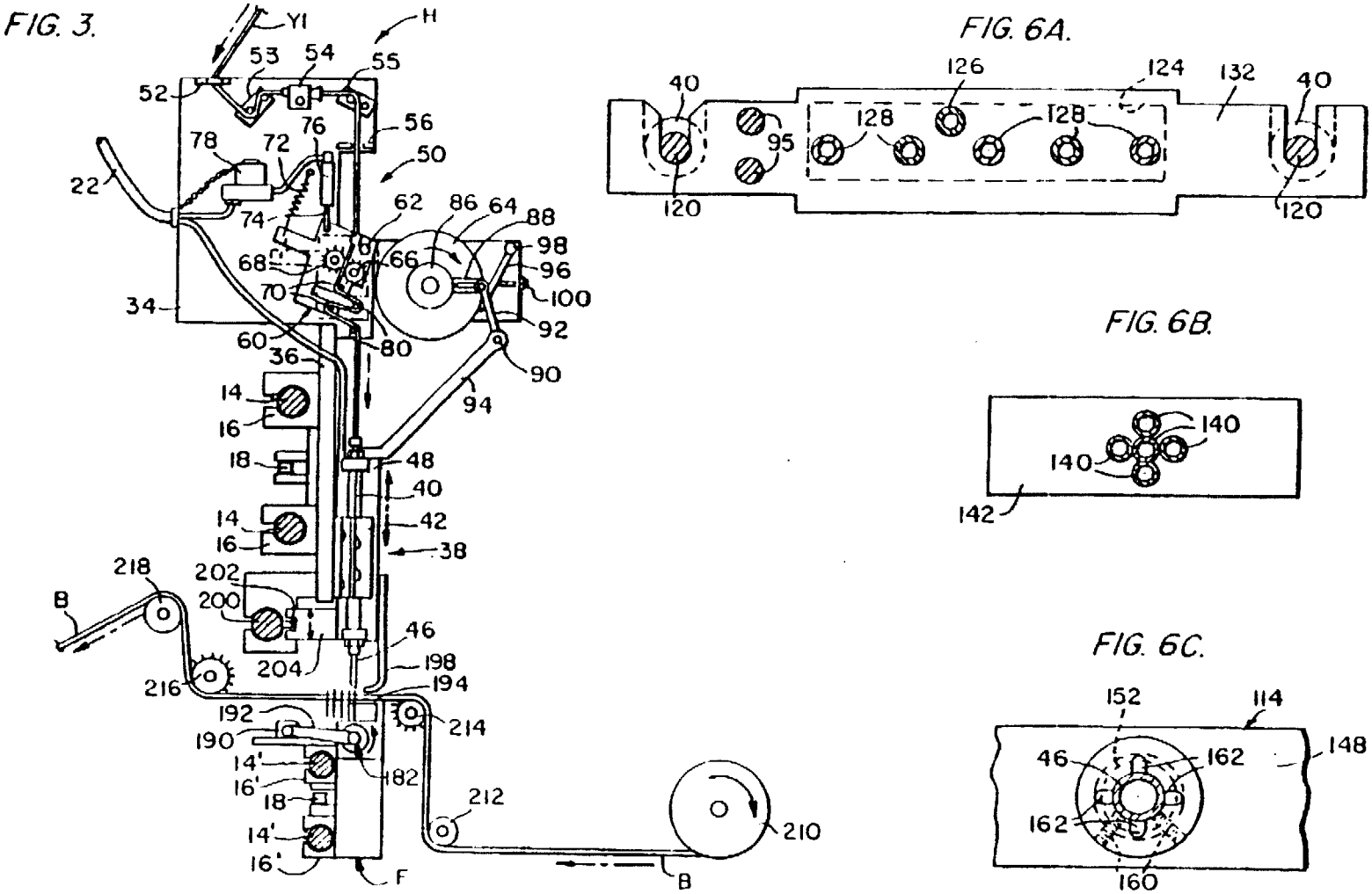
FIG. 3 is a schematic view illustrating the construction of the prior art apparatus of FIG. 1.
FIGS. 6*a*–*c* are cross sectional views taken respectively along the lines 6*a*—6*a*, 6*b*—6*b*, and 6*c*—6*c* in FIG. 4.

FIGS. 2 and 3 illustrate in more detail one of the head assemblies H. The head assembly comprises an upper structure 34 carried by a vertical member 36 to which are affixed the linear bearings 16 for supporting the head assembly on supports 14. A reciprocating thread-applying dement 38 is carried on member 36 and may be connected thereto by means of vertically extending cylindrical guide rods 40 which pass through low friction linear bearings 42 connected to the member 36 so as to enable the thread-applying element to be reciprocated vertically (by a drive system to be described). As will be described in more detail shortly, the thread placement tool comprises a hollow backing opener tube 46 adapted to penetrate the primary backing to implant thread therein, and a thread exchanger 48 which supplies the plurality of threads Y1–Y5 to the backing opener. As will also be described shortly, thread selector and feed mechanisms 50 (one for each of the threads supplied at this location) are disposed in the upper structure 34 of the head assembly for controlling, in response to signals supplied thereto, the selection and feeding of the plurality of different threads to the thread exchanger and the backing opener.

As shown in FIGS. 1 and 2, each head assembly receives all of the different threads from its associated set of spools located in the thread creel. From the thread guides 28 (FIG. 1), the threads may be supplied to the upper rear portion of each head assembly. The color sequences supplied to each location are illustrated for up to seven colors in the two and three color per head systems, but the logic may be extended to any number of colors. The invention is distinguished from the prior art practice of supplying every color to every location by the system of the invention which uses less than the total number of colors at each location, with full spacing traverses to supply additional colors at certain locations. Improved shifting and decreased head size, making closer spacing possible, allows more operation at higher speeds and placement of more threads per stroke.

As best illustrated in FIG. 3 (which illustrates only thread Y1), the threads entering the head assembly pass through a series of thread guides 52, 53, 54, 55, and 56. Guides 52 and 56 may simply comprise horizontal plates connected to structure 34 that have an aperture therein for each of the different threads and which serve to maintain a desired spacing between each of the threads. Guides 53 and 55 may be similar and may comprise a pair of parallel rods which extend between end members that are pivotally connected to structure 34, as best illustrated in FIG. 2 for guide 55, so as to enable the positions of the rods to be adjusted. Guide 54, which is disposed between guides 53 and 55, comprises a tubular member (one for each of the different threads) through which the thread passes. If a thread should break, or if a large body of thread should try to pass through this tube a shut-off switch (not illustrated) will be activated. In addition to maintaining the desired spacing between the threads, the thread guides apply a slight tension to the threads and assist the thread feeding mechanisms in pulling the threads from their individual spools as the head assemblies move back and forth across the primary backing. From guide 56, the threads are fed to the thread selector and feeding mechanisms 50, which will now be described.

The thread selector and feeding mechanisms 50, which are preferably identical, each comprise a thread selector portion for selecting the desired threads for implantation and a thread feeding portion for supplying a length of thread greater than a predetermined length. As shown in FIG. 3 (which illustrates the thread selector and feeding mechanism for thread Y1), each thread selector and feeding mechanism comprises a base member 60 pivotally supported on structure 34, as by a transversely extending rod 62, adjacent to a cylindrical drum 64 which preferably has a surface of resilient material such as rubber and which, as will be described, serves as a common drive roller for all of the thread feeding portions of the mechanisms. Base member 60 carries a pair of rotatable intermeshed gears or rollers 66 and 68, between which the thread is fed, and carries a pair of thread guides 70 about which the thread is threaded, as shown in FIG. 3. Base member 60 is biased, as by a spring 72, in a clockwise direction to the solid line position shown in the figure. The moveable plunger 74 of a thread selector actuator 76 that is carried on the upper structure is attached to the base member as shown. The actuator may be, for example, a pneumatic actuator controlled by a pneumatic solenoid valve 78, as shown, or it may be an electrical or hydraulic actuator. Structure 34 may also carry another pair of fixed thread guides 80 (which may also be transversely extending rods) which cooperate with thread guides 70 carried by the base member to impart (when the base member is in the solid line position) a tortuous path of predetermined length to the thread between gears 66 and 68 and the inlet of the thread exchanger, as shown in FIG. 3. As described hereinafter, this tortuous path serves as a temporary storage for the predetermined length of thread.

Figure 4:
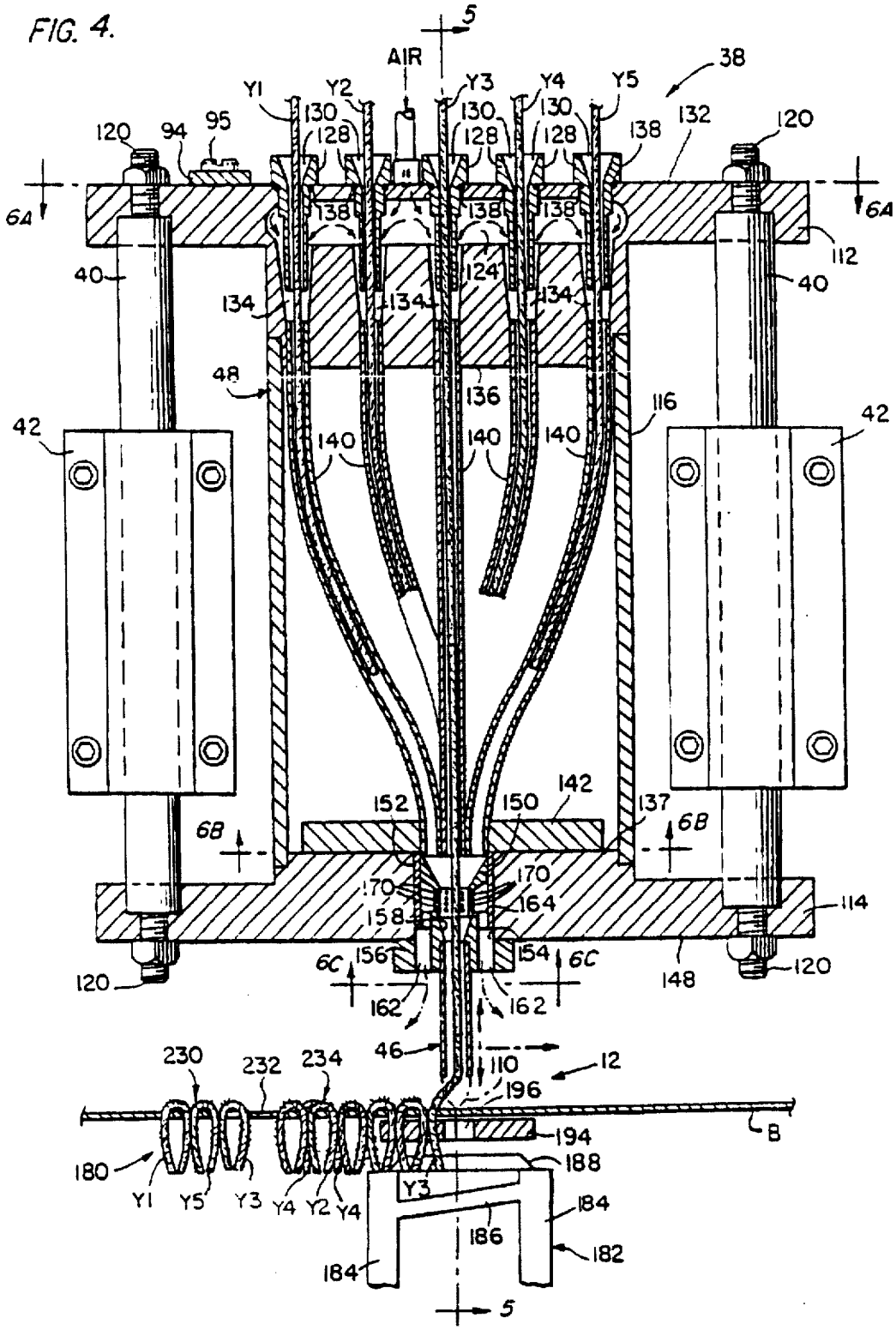
FIG. 4 is a cross sectional view taken approximately along the lines 4—4 of prior art FIG. 5 illustrating a preferred form of a thread placement tool and thread end exchanger in apparatus preferred for practicing the invention.

Upon actuator 76 being actuated, as by a control signal supplied to valve 78 via cable 22, plunger 74 of the actuator extends and causes the base member to pivot (counter-clockwise in the figure) about rod 62 to the phantom line position illustrated. With the base member pivoted to this position, gear 66 engages the surface of drum 64, and thread guides 70 and 80 assume a substantially co-linear relationship so that the tortuous path of the thread between the guides is converted to a substantially straight path. This releases the stored predetermined length of thread corresponding to the length of the tortuous path so that it may be transported to the thread exchanger. Preferably, the length of thread stored in the tortuous path is sufficient to enable the end of the thread to exit the outlet of the backing opener so it can be cut, as described hereinafter. Drum 64 is rotatably supported on a forwardly projecting portion of structure 34 as by a shaft 82 received in bearings 84 (one of which is shown in FIG. 2). As shown in FIG. 3, a one-way clutch or ratchet 86 having a slotted arm 88 may be connected to shaft 82 at one side of the drum, and an arm 88 may be coupled by a pair of pivotally connected (at 90) link members 92 and 94 to the reciprocating thread exchanger 48 to enable the drum to be rotatably driven by the reciprocating thread-applying element. Link member 94 may be connected to the thread exchanger by screws 95, for example, as best shown in FIG. 4.

In FIG. 3, the thread exchanger is shown at the top of its stroke at which the backing opener 46 is positioned above the backing B. As the thread exchanger moves downwardly to cause the backing opener to penetrate the backing, link members 92 and 94 cause drum 64 to undergo a clockwise angular rotation. This imparts a counter-clockwise angular rotation to gear 66, which is in engagement with the surface of drum 64, and causes a length of thread greater than a predetermined length sufficient to ensure that the thread extends beyond the outlet of the backing opener at the bottom of its stroke and is cut, as described hereinafter, to be fed through gears 66 and 68 and supplied to the thread exchanger. When the thread exchanger moves upwardly during the second half of its stroke, one-way clutch 86 rotates counter-clockwise and slips so that drum 64 remains stationary and is not rotated in the opposite direction. Gears 66 and 68 likewise remain stationary during this time, which serves to hold the thread securely. This prevents previously supplied thread from being pulled back, which is undesirable. To minimize free-wheeling or backward (counter-clockwise) rotation of the drum due to friction in the one-way clutch, a transversely extending plate 96 pivoted about an edge 98 thereof may be provided for frictionally engaging the surface of the drum so as to resist counter-clockwise rotation of the drum. The frictional engagement between the surface of the drum and plate 96 may be adjusted, as by means of a screw 100. Accordingly, as the thread-applying element reciprocates upwardly and downwardly to implant thread into the backing, drum 64 undergoes successive incremental clockwise angular rotations so as to feed the selected threads to the thread exchanger during its downward stroke. The amount of thread supplied to the thread exchanger may be controlled by controlling the amount of angular rotation of the drum, which may be adjusted by adjusting the location at which link member 92 connects to slotted arm 88.

As previously noted, the apparatus of the invention has the capability of implanting any number and any combination of the different threads into the backing. The precise manner in which this is accomplished will be described shortly. However, it is sufficient at this point to note that, as previously indicated, each of the threads has its own thread selector and feeding mechanism. (FIG. 2 illustrates the five actuators 76 and associated valves 78 corresponding to the five threads Y1–Y5.) Selection and feeding of the desired threads is accomplished by supplying control signals to the appropriate valves 78 to actuate the actuators associated with the selected threads. The selected threads are then fed to the thread exchanger by the rotation of drum 64 as long as their corresponding actuators remain actuated. Upon an actuator being deactuated, its corresponding base member 60 is returned to the solid line position indicated in FIG. 3 by spring 72. The moveable thread guides 70 carried by the base member cause the thread to be pulled around the fixed thread guides 80 so that the thread assumes the tortuous path indicated in FIG. 3. As will be described shortly, this serves to pull back and store a portion of the thread previously supplied to the thread exchanger, and gears 66 and 68 cooperate to hold the thread and prevent it from being transported through the thread exchanger to the backing opener.

An improved embodiment of the thread feed apparatus includes a pullback mechanism that assures that a previously fed thread is drawn back a controlled amount from the hollow needle or backing opener to preclude restriction of the feeding of a subsequent thread each time a thread change is made. Additionally, the improvement assures that when the thread is pulled back from the hollow needle, thread is not pulled from the thread supply direction.

To these ends, the thread feed apparatus of the present invention includes a pullback mechanism disposed between a thread feed roller and the hollow needle, the pullback mechanism acting to pull the thread a preselected amount from the needle so that the thread passageway in the needle is not restricted by the previous thread when a subsequent thread is to be sewn. Additionally, to assure that the pullback mechanism draws thread from the needle and not from the thread supply or the feed roller, clamping apparatus is disposed between the thread feed roller and the pullback mechanism. The clamping apparatus positively clamps the thread when a thread change is to be made. The pullback mechanism is thereafter activated and the thread feed roller ceases positive feeding of the thread. Thus, the thread pullback mechanism draws a predetermined amount of thread from the needle maintaining it in reserve until again required. Additionally, the thread feed roller as it ceases positive feeding draws a preselected amount of thread from the thread supply for immediate subsequent use when needed. When the needle is to commence stitching with a particular thread, the thread feed roller is activated and the thread clamping apparatus and thread pullback mechanism are deactivated. The thread pullback mechanism is illustrated and described in detail in U.S. Pat. No. 5,080,028, and is summarized below.

The thread pullback mechanism includes a rod or plunger having a passageway or eyelet which moves relative to a pair of thread guides fixed to the frame, and the plunger is disposed between the thread guides. This mechanism, as hereinafter described, acts to retract thread from the thread placement tool or backing opener tube after a stitch has been formed and cut by the cutting apparatus, the thread preferably being pulled into the thread exchanger. A thread ejector device associated with each thread placement tool receives a plurality of different threads, each thread having a separate passageway, along with pressurized air directed into each passageway from a pneumatic supply device. The supply device supplies high pressure air to the passageway having thread that has been selected for ejection into the thread placement tool or backing tube opener and supplies low pressure air to the other passageways, the pressure selection being by pressure regulators and control means. Each thread strand entering the ejector device is fed to the thread exchanger through a separate supply tube which connects the ejector device to the thread exchanger. A separate air line for each thread tube is connected to the ejector device to enable compressed air to be ejected into each thread passageway in a controlled manner selectively to transport the selected thread pneumatically under the higher pressure through the tube to the backing opener. The low pressure air supplied to the ejector and thus the other air supply tubes ensure that the other threads are available without delay after another respective thread has been selected to be transported to the thread placement tool or backing tube opener. Additionally, the same or preferably another pneumatic supply may supply pressurized air to the actuator and the pullback mechanism.

The thread ejector device, thread supply tubes and thread exchanger together function in a similar manner to the thread exchanger described above and operate in a similar manner, the difference being that in the apparatus described above, the thread exchanger and the thread ejection device are incorporated into a common unit. A particular thread may be selected for implantation into the backing by appropriately controlling the air supplied to the respective pneumatic actuator to pivot the member associated with the selected thread so that the corresponding feed roller is moved into engagement with the drive roller; by controlling the air supplied to the thread pullback mechanism to extend the plunger and release the thread previously drawn from the thread supply; and by controlling the compressed air supplied to the ejector device to transport the selected thread to the thread exchanger. When the actuator is actuated to extend the rod, the member is pivoted to force a first roller against a second roller so that the thread, which initially is the thread held in reserve, is fed toward the respective thread placement tool or backing opener tube. Additionally, the plunger is extended from the pullback mechanism so that the eyelet or passageway permits the thread to be fed toward the thread placement tool or backing opener tube, the extension of the rod and the plunger occurring substantially simultaneously. When the actuator is controlled to retract the rod, the member is pivoted to disengage the second roller from the first roller and terminate the feeding of the previously fed thread. Also, the plunger is retracted into the pullback mechanism to draw back thread that has been fed but not used by the thread placement tool and held ready, as in a storage tank or plenum, until that thread is again fed.

The purpose of the pullback mechanism is to ensure that a previously fed thread is drawn back into the vicinity of, and preferably into, the thread exchanger so that a blockage does not occur within the thread placement tool or backing tube opener which would restrict the feeding of the subsequently fed thread. In the preferred apparatus, this permits substantially less air pressure to be required to feed the thread from the thread exchanger to the thread placement tool or backing opener tube. To ensure that the pullback mechanism draws thread back from the thread placement tool rather than from the thread supply, and to preclude any thread from being drawn from the reserve resulting when the feed roller is moved out of engagement with the drive roller, the thread pullback also includes a clamping means. The clamping means includes an actuator unit having a rod to which a clamping block is secured. The clamping block has a protuberance at the upper surface thereof, the protuberance being receivable within a notch formed in a fixed plate when the rod is retracted into the actuator unit, the plate being that to which the actuator is fastened. The actuator unit is fed with a controlled supply of air from the pneumatic supply.

When thread is fed by the thread supply system, the rod of the actuator unit is extended substantially simultaneously with the extension of the plunger and the pullback rod to permit the thread to be fed to the thread placement tool or backing tube opener. After the thread that has been fed has formed one or more stitches and it is desired to change to another thread, and prior to retraction of the first thread by the pullback mechanism, the actuator unit is deactivated to retract the clamp rod resulting in the thread being clamped between the protuberance and the notch. A mechanical exhaust valve is disposed on the plate and when the clamp block is retracted to the clamping position, after the thread is clamped, the valve acts to exhaust the actuator and the thread pullback mechanism. The valve thus signals the actuator and the pullback mechanism and functions as a signaling means. When the pullback mechanism plunger is thereafter retracted, all of the thread that is pulled back to the thread exchanger comes from the thread placement tool or backing tube opener. This not only ensures that the thread is not pulled from the thread supply, except by the feed roller in moving from the drive roller, and controls the amount of thread that is pulled from the thread placement tool or backing tube opener, but also ensures that the extra thread drawn by the feed roller when moving from the drive roller is available to be supplied to the thread placement tool or backing tube opener. This compensates for the stretching and resiliency characteristics of the thread which could result in not enough thread being fed to the thread placement tool or backing tube opener for the subsequent stitch made by that thread.

Figure 5:
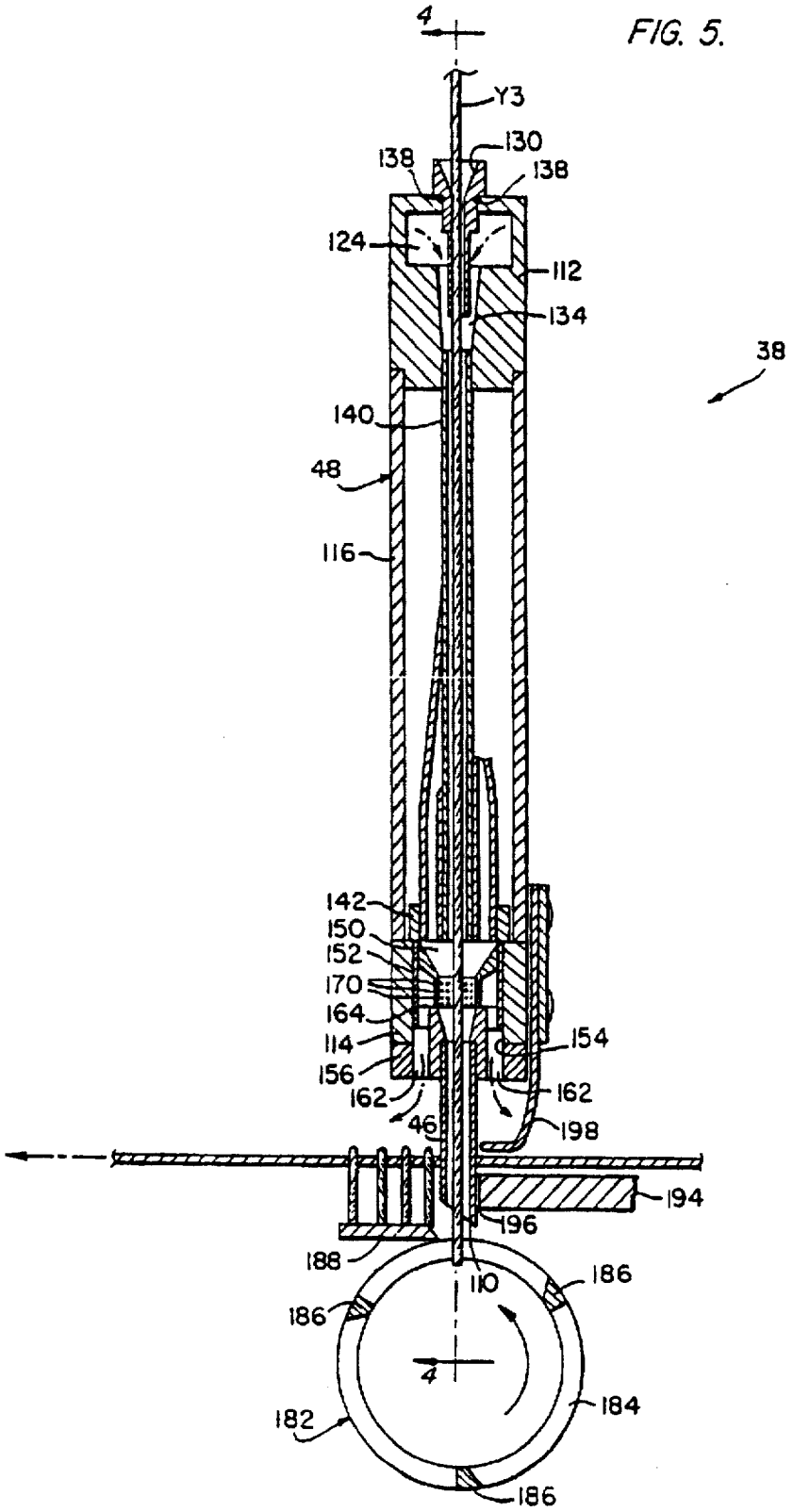
FIG. 5 is a cross sectional view taken approximately along the lines 5—5 of FIG. 4.

FIGS. 4, 5 and 6A–C illustrate in more detail the reciprocating thread-applying element 38 of the head assembly, comprising backing opener (or other thread placement tool) 46 and thread exchanger 48. As noted earlier, the function of the backing opener is to penetrate the primary backing to implant thread therein, and the function of the thread exchanger is to transport the selected threads to the backing opener. As best illustrated in FIGS. 4 and 5, backing opener 46 may comprise a hollow tube, as of stainless steel, having a pointed tip 110 designed to facilitate separation of the primary backing B and penetration of the backing opener. Preferably, the inner diameter of the backing opener tube is sufficient to pass all five threads simultaneously.

Thread exchanger 48 may be a substantially rectangular structure comprising a top piece 112, a bottom piece 114, and a central section 116 connecting the top and bottom pieces. The top and bottom pieces may have transversely extending portions formed for connection to guide rods 40, as shown, for example, in FIGS. 4 and 6A. The guide rods may comprise cylindrical members that pass through linear beatings 42 and have threaded end portions 120 for connection to the extending portions of the top and bottom pieces. Top piece 112 may have formed in the upper portion thereof a cavity 124 which serves as a plenum and which receives air or other gas from an inlet line 126, which, as shown in FIG. 3, may be included within cable 22. A plurality of shouldered tube-like inserts 128, one for each of the different threads, having funnel-shaped inlets 130 may extend from the upper surface 132 of top piece 112, through plenum 124, and a portion of the way into a corresponding tapered passageway 134 that connects the plenum with the lower surface 136 of the top piece. O-rings 138 may be used to provide a seal between the plenum and the inserts. A plurality of hollow tubes 140, one for each passageway, may extend downwardly from the passageways in the top piece through the central section 116 and terminate in a plate 142 mounted on the upper surface 137 of bottom piece 114. At the lower surface of the top piece, the tubes are substantially co-linear with the long axis of the top piece. However, as they extend downwardly, they curve and converge together in a substantially circular cluster at plate 142, as indicated in FIG. 6B. The tubes, which may be of stainless steel, may be press fitted into passageways 134 and into corresponding holes drilled through plate 142.

Tubes 140 provide individual passageways between the top and bottom pieces for the threads entering the thread exchanger through inserts 128. As the threads exit tubes 140 at the bottom piece, they enter a funnel-shaped insert 150 within the bottom piece which serves as an inlet for the backing opener and guides the threads therethrough. The insert may be disposed within a cylindrical sleeve 152 which is pressed into a cylindrical opening 154 in the bottom piece. A backing opener clamp member 156 (shown also in FIG. 6C) is mounted on the lower surface 148 of the bottom piece. As shown in FIGS. 4 and 5, the sleeve 152 also has a funnel-shaped central portion 158 which supports insert 150 and leads into the top of the backing opener tube. As shown in FIG. 6C, the backing opener may be secured within the sleeve 152 against a shoulder of its central portion, as by set screws 160 in the clamp member 156. A plurality of holes 162 may extend upwardly through the clamp member substantially parallel to the axis of the backing opener to provide passageways that communicate with an annular cavity 164 formed between the outer surface of funnel-shaped insert 150 and the inner surface of sleeve 152. As shown in FIGS. 4 and 5, the lower cylindrical portion of the funnel-shaped insert may have a plurality of small holes 170 therethrough that provide air passageways between cavity 164 and the interior of the funnel-shaped insert.

The threads entering the thread exchanger through inserts 128 are transported pneumatically through the thread tubes 140 and the backing opener 46. As shown by the arrows in FIG. 4, the pressurized air or other gas entering plenum 124 in the top piece from line 126 flows through the tapered annular space between tapered holes 134 in the top piece and the lower portions &inserts 128 and enters the tops of tubes 140. The air, which flows through tubes 140, the funnel-shaped insert 150, and the backing opener 46, exits the lower end of the backing opener, principally, and creates a vacuum in inserts 128 that moves the threads through the tubes and the backing opener. Air passageways 170 through the lower cylindrical portion of the funnel-shaped insert enable a portion of the air entering the insert 150 to be vented into annular chamber 164 and exhausted out through holes 162 in clamp 156. Significantly, the air passageways prevent the formation of a back pressure in the funnel-shaped insert 150 and at the inlet of tubes 140 that could inhibit the transport of the threads through the tubes and the backing opener and that could possibly cause the air to reverse its flow and exit out of the inserts 128 in the top piece 112, blowing the threads out of the thread exchanger. The amount of air exhausted by the air passageways 170 varies in accordance with the effective area of the air passage through the backing opener. As the number of threads passed through the backing opener increases, its effective area decreases and a greater portion of the air is exhausted by air passageways 170. Preferably, the total area of the exhaust opening provided by the air passageways 170 is selected such that air flowing into insert 150 from tubes 140 can be substantially completely exhausted even with the backing opener totally blocked, or at least such that the threads are not blown out of the top of the thread exchanger. In effect, the air passageways function as a pressure regulator which maintains a substantially constant predetermined pressure at the backing opener and which affords a substantially constant force on the threads, as the number selected varies, for transporting the threads through the thread exchanger and the backing opener.

During operation, a constant supply of air is provided to plenum 124 and, by virtue of air passageway 170, a substantially constant force is exerted on the threads to transport them through the tubes 140 and the backing opener, as just described. However, only the selected thread or threads are allowed to pass through the backing opener, the non-selected threads being restrained by the intermeshed gears of their thread feeding mechanism (previously described in connection with FIG 3). Upon a thread being selected for implantation, its associated thread selector actuator is actuated, as previously described. This releases the predetermined length of thread stored in the tortuous path and allows it to be quickly transported through the backing opener by the air flow therethrough. When the thread selector actuator is subsequently deactuated, its associated base member 60 pivots to the solid line position illustrated in FIG. 3 and the moveable guides 70 carried thereon cause a portion of the thread (corresponding to the predetermined length of the tortuous path) that was previously supplied to the thread exchanger to be pulled back. It is desirable to pull back non-selected threads so that their ends are away from the outlet of the backing opener in order to minimize fraying of the thread ends. Although the ends of threads Y1 and Y5 in FIG. 4 are shown located within the thread tubes 140, the ends may actually terminate within the backing opener tube at a location such that they do not exit the opening of the backing opener tube as it reciprocates. The exact locations of the ends of the non-selected threads are not particularly important and will vary in accordance with thread characteristics such as diameter, stiffness, elasticity, etc.

FIGS. 4 and 5 illustrate the position of the backing opener at two different times during its stroke. In FIG. 4, the backing opener is shown near the top of its stroke as it is moving downwardly to penetrate the backing B. In this figure, the backing is being advanced into the plane of the drawing, and the head assembly is being moved transversely across the backing (to the right in the figure) to implant a transverse row 180 of thread rafts. In FIG. 5, the backing opener is shown near the bottom of its stroke, having penetrated the backing. In this figure, the backing is being advanced to the left, and the head assembly is being moved transversely across the backing in a direction normal to the plane of the drawing. As shown in these figures, as the thread is inserted into the backing it may be cut by a rotary cure 182, disposed on the opposite side of the backing from the head assembly. Rotary cutter 182 may comprise a pair of rotating members 184 having a plurality of angled blades 186 extending therebetween which cooperate with a stationary blade 188 to shear the thread inserted between the stationary and the rotating blades to form cut pile mils. The rotary cutter may be driven by an electric motor 190 and drive belt 192, for example, as shown in FIG. 3. The rotary cutter may be arranged such that its distance below the backing can be adjusted for different pile heights. An advantage of using a rotary cutter having the structure shown is that inconsistencies in the overfeed of threads by the thread feeding mechanisms are cut off, and a very smooth product is produced since all of the thread rafts are cut at the same height.

A pressure plate 194 having a semicircular cutout sized to pass the backing opener may also be disposed adjacent to the opposite side of the backing from the head assembly for supporting the backing during penetration by the backing opener. As shown in FIG. 3, the rotary cutter and pressure plate may be carried on a foot assembly F that is moved transversely across the underside of the backing in synchronism with the head assembly H. The foot assembly may be supported on a pair of transversely extending rods 14' by low friction linear bearings 16' in a manner similar to the head assembly, and may be moved transversely by the same drive system employed for moving the head assemblies via a drive chain 18' coupled to the drive system. A vertically stationary presser foot 198 connected, for example, to linear beatings 42 (see FIG. 2) may also be carded by the head assembly adjacent to the backing to minimize the upward movement of the backing during retraction of the backing opener.

As is shown in FIGS. 2 and 3, reciprocation of the thread exchanger and backing opener may be accomplished by means of a transversely extending rockable shaft 200 having a cam portion 202 that cooperates with a member 204 connected to the thread exchanger. Shaft 200, which extends the entire transverse width of the apparatus, may be driven by a suitable head reciprocating drive system (not illustrated) which causes the shaft to undergo a predetermined back and forth angular rotation about its longitudinal axis. As the head assemblies are driven transversely across the backing, the back and forth rocking motion of the shaft imparts a synchronous reciprocating motion to the thread exchangers and backing openers of the head assemblies, causing the backing openers to repetitively penetrate the backing as the head assemblies are moved transversely across the backing.

As is further shown in FIG. 3, the primary backing B may be supplied from a supply roll 210, fed about a roller 212, and advanced past the work-applying region 12 of the apparatus by a pair of splined rollers 214, 216 connected to a backing advance drive system (not illustrated) which incrementally advances the backing past the work-applying region after each transverse row of tufts is implanted. The spined rollers serve to maintain the backing under tension as it passes through the work-applying region. As the backing leaves the last splined roller 216, it may pass over another guide roller 218, and may be connected to a take-up system (not illustrated).

Figure 7:
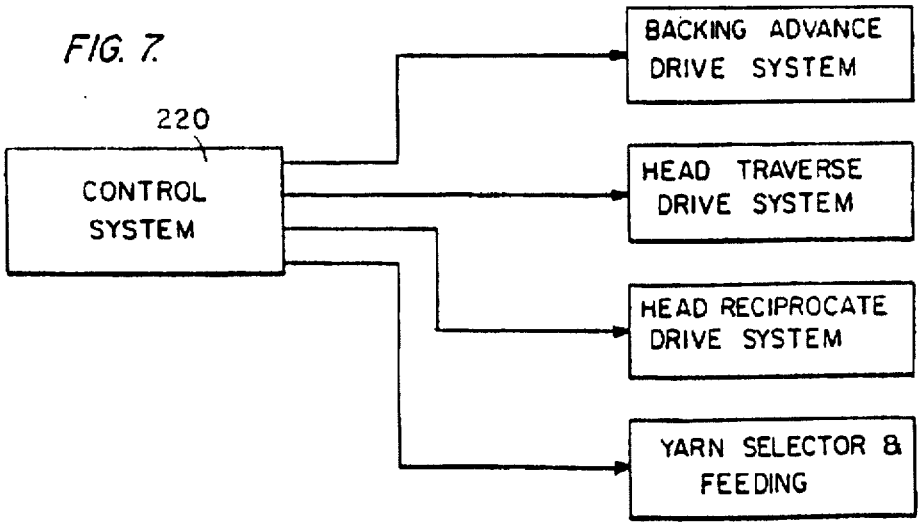
FIG. 7 is a block diagram illustrating the control means for the prior art apparatus of FIG. 1.

As is illustrated in FIG. 7, the apparatus may further include a control system 220 for controlling the backing advance drive system, the head or backing traverse drive system, the head reciprocate drive system, and the thread selector and feeding mechanisms. Control system 220, which is preferably a computer, controls the timing and the actuation of the drive systems and the thread selector and feeding mechanisms of the apparatus. The microcomputer conveniently enables the amount of advancement of the primary backing to be varied so as to vary the spacing between transverse rows of tufts, and conveniently enables variation in the thread insertion locations (as by controlling a stepping motor, for example, in the head traverse drive system) so as to vary the distances between thread tufts in a transverse row. Moreover, a microcomputer may be easily programmed so as to enable different patterns or designs to be produced.

A complete prior art operating cycle of the apparatus of FIG. 1 will now be described, then compared with the operation according to the invention. Initially, it should be noted that the head assemblies H are moved first in one direction across the width of the backing to implant a first transverse row of tufts, the backing is advanced to the location of the next row of tufts, and the head assemblies are then moved in the opposite direction to implant that row of tufts. The heads traverse the distance between the needles for each row placed. The number of incremental traverse shifts depends on the spacing or gauge the tufted material. The spacing is conventionally referred to as "gauge" which is the number of stitches per inch (or per 2.54 cm). Thus a 10 gauge tufted material has ten stitches or shifts per inch. With the current commercial CYP machines, the heads are typically on two inch centers and tufting at ten gauge requires 20 transverse shifts, 12 gauge requires 24 shifts. Assuming that the left-hand head assembly of FIG. I is positioned at the left side of the backing and that the backing has been advanced to the position of the next transverse row, the right-hand head assembly will be positioned such that its backing opener is at the midpoint of the width of the backing. The head assemblies are then moved transversely across the backing such that the left-hand head assembly implants tufts in the left side of the backing and the right-hand head assembly implants tufts in the right half of the backing. Upon completing the transverse row, the backing is incrementally advanced to the position of the next transverse row, and the head assemblies are driven in the opposite direction, i.e., right-to-left in FIG. 1, to implant that transverse row of tufts. This process is repeated with the head assemblies moving in opposite directions for succeeding rows until transverse rows have been implanted in a desired length of the backing. As previously noted, the apparatus may employ a large number more than two head assemblies, e.g., 23, 46, or 92 for a fifteen foot backing width, in which case the operation would be the same except that each head assembly would be required to cover a smaller segment of the width.

The head transverse drive system preferably incrementally steps the head assemblies a distance equal to the desired distance between successive thread implantations during the portion of the stroke when the backing opener is withdrawn from the backing. Alternatively, the transverse drive system could move the head assemblies continuously. Although this would result in some pulling of the backing as the backing opener is moved while it is inserted into the backing, the backing would quickly readjust itself upon the backing opener being withdrawn. The head reciprocation drive system may also be operated intermittently, although it is preferred to operate it continuously, in which case the speed of the transverse drive system would be adjusted so as to afford the desired distance between successive penetrations.

In a preferred embodiment, an improved tufting apparatus is employed which includes a plurality of reciprocating backing opener tubes, the positions of which are fixed transverse to the direction of advancement of the backing through the apparatus. In order to implant a transverse row of tufts into the backing, the backing itself is shifted transversely in incremental steps corresponding to the spacing between adjacent thread insertions. This enables the relatively heavy and complex heads of the previous apparatus to be eliminated and replaced by a plurality of closely-spaced backing openers disposed on a common transversely-extending reciprocating bar. This has the advantage of enabling close control over the positions of the backing openers and avoids the possibility of any relative movement between the backing openers. By employing a relatively-close spacing between backing openers, the distance that the backing must be shifted may be kept small. This facilitates accurate shifting of the backing. This embodiment is described in detail in U.S. Pat. No. 4,991,523, and is summarized below with reference to FIG. 8.

The selection of the thread or threads to be implanted at each insertion of the backing opener is made at the bottom of the backing opener stroke (the timing of the control signals which control thread selector actuators 76 may be adjusted so as to occur prior to the bottom of the stroke to compensate for delay in the reaction times of the mechanism). Upon a thread being selected for implantation, the selector actuator 76 of its corresponding thread selector and feeding mechanism is actuated to pivot its corresponding base member 60 counter-clockwise (in FIG. 3) as previously described. This moves moveable thread guides 70 into substantial alignment with fixed thread guides 80, thereby providing a substantially straight path for the thread from intermeshed gears 66 and 68 to the thread exchanger and releasing the stored length of thread. Upon being released, the thread is quickly pulled through its thread exchanger tube and the backing opener by the air flowing therethrough, and is sheared by the rotary cutter. As the backing opener moves upwardly to the top of its stroke and moves transversely to the location of the next thread tuft, the air flow through the backing opener maintains the thread in place within the backing. Then, as the backing opener moves downwardly during the next portion of the stroke, drum 64 rotates clockwise, as previously described, imparting rotation to gears 66 and 68 to feed a length of thread at least sufficient to exit the outlet of the backing opener. Once selected, a particular thread may remain selected for at least one complete cycle of the backing opener, i.e., from the bottom of one stroke to the bottom of the next succeeding stroke, comprising two successive insertions of the backing opener into the backing.

As shown in FIG. 4, this leaves inverted U-shaped lengths of thread tufts implanted in the backing. For operation of present invention, it should be understood that the placement of two threads in a complete cycle is considered a single shift as that term is used to describe operation of the invention below.

The de-selection of a previously selected thread also occurs at the bottom of the backing opener stroke. Upon the selector actuator of the de-selected thread being deactuated, its corresponding base member 60 pivots (under the influence of spring 72) back to the solid line position illustrated in FIG. 3. The movement of thread guides 70 relative to fixed thread guides 80 causes the de-selected thread to be pulled back from the exit of the backing opener (and out of the backing) up into either the backing opener tube, the funnel-shaped insert 150 or its thread supply tube 140, as previously described. Simultaneously, the selector actuator of a desired thread or threads, if any, is actuated allowing the length of the selected thread that was previously pulled back to be released from temporary storage and transported through the backing opener, as described above.

FIG. 4 illustrates a portion of a transverse row 180 of U-shaped thread tufts implanted in backing B. As previously described, different threads (Y1, Y5 and Y3, for example) may be selected for each successive tuft, as shown in region 230; no threads may be implanted at a location, as shown at 232; or a plurality of different threads (Y2 and Y4, for example) may be implanted at a particular location, as shown at 234.

Figure 8:
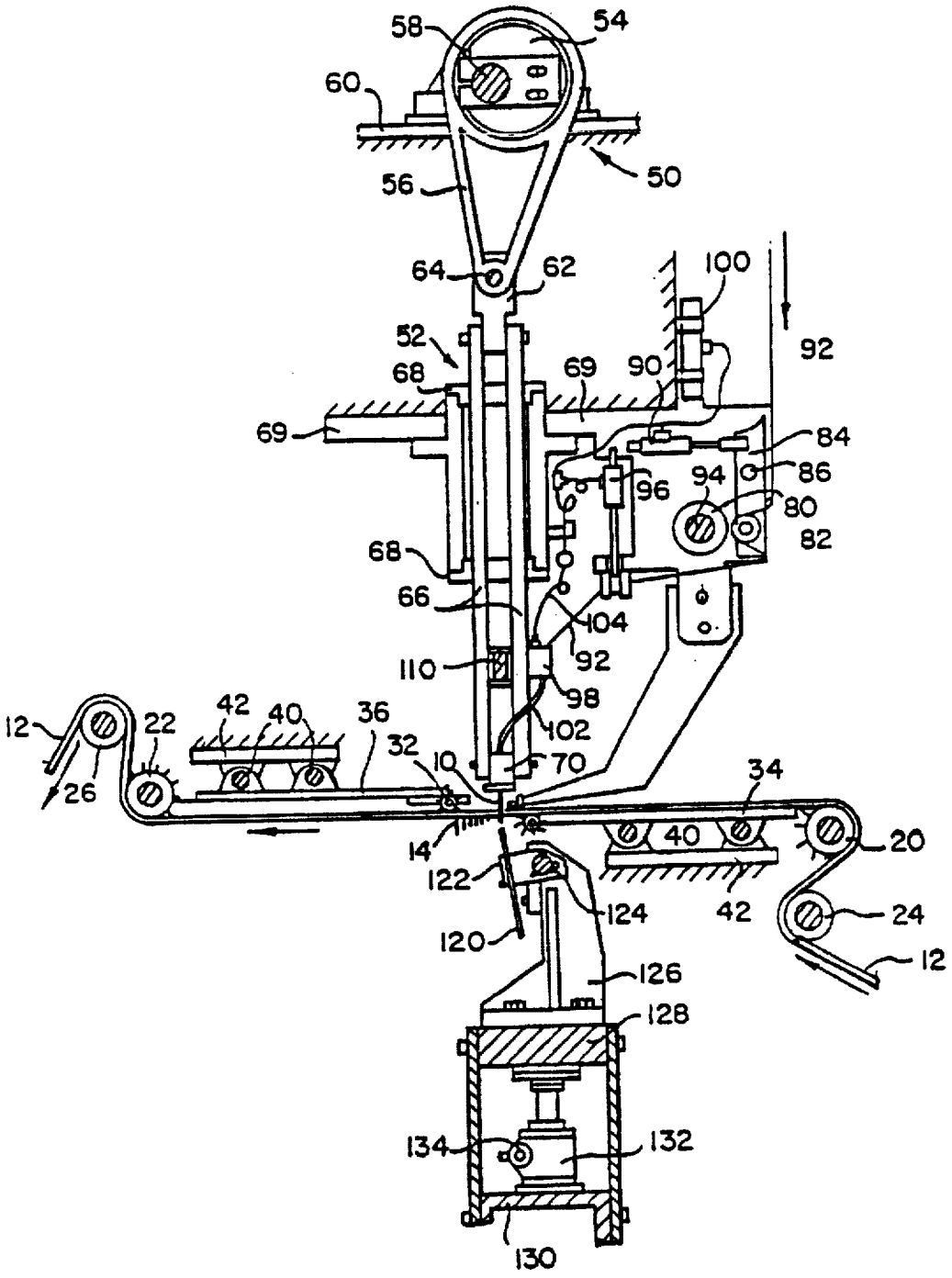
FIG. 8 is a longitudinal side view, in partial cross section and partial diagrammatic, of a tufting machine wherein the backing can be shifted for carrying out the method of the invention.

As noted above, a preferred embodiment of the apparatus for practicing the invention includes the capacity to shift the backing. FIG. 8 shows a tufting machine having a backing shift capability, more specifically FIG. 8 is a longitudinal side view, partially in cross section and partially diagrammatic, illustrating improved tufting apparatus in accordance with the disclosure of U.S. Pat. No. 4,991,523. The tufting apparatus of FIG. 8 may comprise a reciprocating backing opener tube 10 for penetrating a primary backing 12 to implant thread tufts 14 therein. The primary backing 12, which may be in the form of a continuous running web, for example, may be advanced longitudinally past the reciprocating backing opener (to the left in FIG. 8 as indicated by the arrow) by a backing advance system which may comprise a pair of pin rollers 20 and 22 which are driven (as by electric motors which are not illustrated) at slightly different rotational speeds so as to maintain the backing under tension as it passes the reciprocating backing opener. The backing advanced system may further comprise a pair of guide rollers 24 and 26 which cooperate with pin rollers 20 and 22, respectively, to guide the backing. As shown in the figure, a second pair of pin rollers 30 and 32, which may have smaller diameters than pin rollers 20 and 22, may be located closely adjacent to the reciprocating backing opener 10 on opposite sides of the backing. Pin rollers 30 and 32 provide better control of the backing in the area where the tufts are implanted. As shown in the figure, pin roller 30 may be carried on a bed plate 34 at the lower side of the backing and be disposed adjacent to the location at which the backing opener penetrates the backing. Pin roller 32 may be carried on a second plate 36 disposed at the upper side of the backing and be located just downstream from the reciprocating backing opener. Plates 34 and 36 are preferably transversely shiftable for reasons which will be described.

Pin rollers 20 and 22 may also be carried on the shiftable plates 34 and 36, respectively, as indicated in the figure. To enable movement, each of the plates 34 and 36 may be carried on a pair of transversely extending shafts 40 which are supported by fixed portions 42 of the frame of the apparatus. Plates 34 and 36 may be mechanically connected together and to a transverse positioning mechanism (not illustrated) which enables the plates as well as the pin rollers and their associated drive system to be shifted in unison transversely to the direction of advancement of the backing. This produces a corresponding transverse shifting movement of the backing, which is desirable for reasons noted above. The transverse positioning mechanism may be any of a number of commercially available devices, such as pneumatic or hydraulic cylinders, which are capable of producing very small and precisely controlled movements. Preferably, the positioning mechanism enables precisely controlled movements of the order of a tenth of an inch or less. Rollers 24 and 26 may also be shifted transversely along with pin rollers 20 and 22. This may be accomplished by a second, less precise shifting mechanism.

The tufting apparatus described previously above employs a plurality of tufting heads which are stepped transversely in synchronism across the backing. In contrast, the tufting apparatus in FIG. 8 may employ a plurality of transversely stationary backing openers which may be connected together, as by a transversely extending bar 110. The apparatus may employ several adjustable cam assemblies 50 spaced transversely across the width of the backing and connected to shaft 58 to reciprocate the backing openers in syncronism to penetrate the backing. Each backing opener implants one or more selected threads as determined by a control system such as a computer which controls the thread supplying and control systems of the apparatus. In order to implant a transverse row of tufts, the backing is shifted transversely, as previously described, in small increments corresponding to the spacing between adjacent mils. The combination of the shifting large diameter pin rollers 20 and 22 and the small diameter pin rollers 30 and 32 spaced closely adjacent to the backing opener region afford good control over the backing as it is shifted transversely and avoid any tendency of the backing to skew. Rollers 24 and 26, which respectively guide the backing onto pin roller 20 and from pin roller 22, may also be shifted transversely by a separate shifting mechanism as previously indicated which need not be as precisely controlled as the mechanism which shifts the plates and pin rollers in the region where the backing is being tufted.

Figure 9:
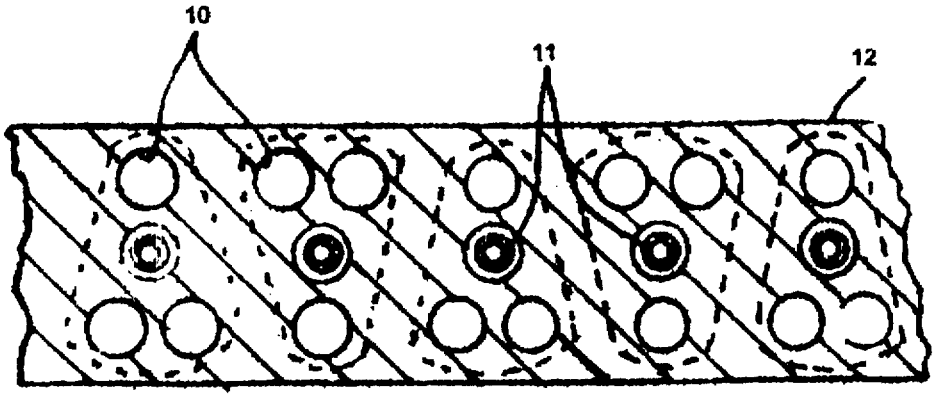
FIG. 9 is a plan view of heads for tubular thread placement tools each having three thread end supply sources.
Figure 10:
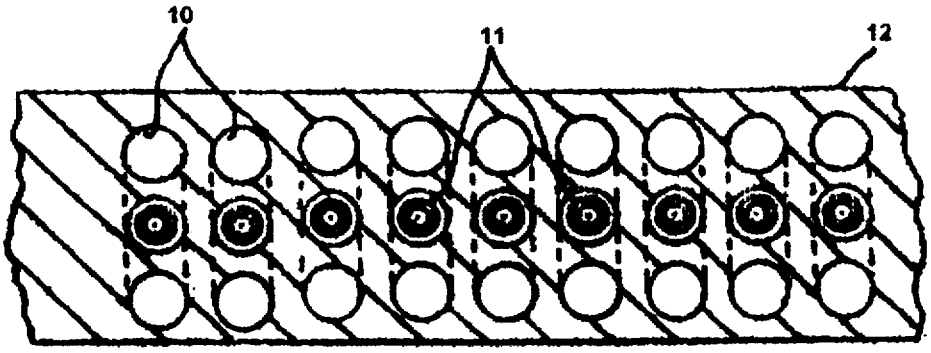
FIG. 10 is a plan view of heads for tubular thread placement tools each having two thread end supply sources.

As previously noted, this backing shifting arrangement has a number of advantages over the earlier moving head apparatus described above. It enables the relatively heavy and complex moving heads of the earlier apparatus to be eliminated. This simplifies the apparatus, affords closer control over the positions of the backing openers and avoids the possibility of relative movements between the backing openers, and increases production speed. An additional advantage of the present invention carries the improvement a step further as the much simpler and smaller heads as illustrated in FIGS. 9 and 10, also allow a much closer placement of heads. By using a larger number of backing openers with a relatively small spacing between adjacent backing openers, e.g. 0.5 inches, the backing need be shifted transversely only by this rather small total distance in order to implant a complete transverse row of tufts.

The lighter heads preferred for the present method of operation permit an additional refinement if desired. The transversely moving heads may be retained while also incorporating the mechanism to shift the backing. The actual time required and distance traveled for heads and backing can be greatly reduced by moving the heads in one direction while shifting the backing in the opposite direction, thus reducing the distance traveled by either by one half.

Another significant aspect of the apparatus of U.S. Pat. No. 4,991,523 as shown in FIG. 8 is the improved thread-cutting mechanism, which results in little or no wasted thread in the production of cut pile goods. The improved tufting apparatus of the invention may include a cutting mechanism comprising a separate knife blade 120 for each backing opener. The blades are disposed on the opposite side of the backing from the thread exchangers and the reciprocating mechanism for the backing openers, as indicated in FIG. 8. The blades are arranged to cooperate with the backing openers by sliding over the angled surfaces which form the pointed tips of the backing opener in a shearing-like action to cut thread that is ejected from the backing openers. This improved cutter may be used with the current invention. Additional improvements such as the improvements to air supply and tangle prevention disclosed in U.S. Pat. No. 5,165,352 may also be incorporated into the present invention.

As noted above, the improvement of the present invention includes the recognition that every different color to be included in a pattern need not be supplied at every thread placement tool location. Instead, a threading pattern is employed such that a smaller number of threads is supplied to each location and shifting is used to bring all colors to each tufting location. Thus, in contrast to the conventional operation described above, a portion of the desired thread colors is supplied to the first thread placement tool location and a substantially equal portion is supplied to additional locations.

The advantage of the simplified head and closer head placement is apparent from tables 1 and 2. The total shifts required for particular stitch densities and total shifts to traverse the tool to tool distance while making every color available at every location are illustrated in tables 1 and 2 for two and three colors to each thread placement tool, for up to six colors and up to 12 stitches per inch (2.54 cm), assuming the one half inch (1.27 cm) spacing of heads possible with the improved apparatus of the invention as compared to the currently used CYP machine on 2 inch (5.08 cm) centers. When simple patterns of less than six colors are adopted the invention method increases speed up to 400% while significant increases occur event at ten and 12 gauge and six color operation. For smaller gauges the advantages are even more pronounced.

It should be noted that the machine as illustrated in FIGS. 1 through 6 is greatly simplified. An actual machine has many thread exchange structures and thread placement devices. FIG. 9 and FIG. 10 show top views of a group of simplified thread exchangers having passages for two and three threads per thread placement tool, showing the more compact structure possible when the machine is adapted for practice of the invention. The views are taken at approximately the same position in the machine as line 6B, modified to view the thread placement tool below. FIG. 9 illustrates a bar housing 12 with thread passageways 10 and five hollow thread placement tools 11 configured to supply three threads per backing opener in an improved CYP machine. FIG. 10 shows thread passageways 10 and nine hollow backing openers 11 in bar housing 12 for a two thread per opener head design. Other than the redesigned configuration as illustrated, the thread exchangers function in the same way as described above. The thread supply is correspondingly simplified, although the threading patterns according to the invention as shown in FIGS. 11 and 12 are somewhat more complex, and require close attention in setting up the machine.

Method

Figure 11A:
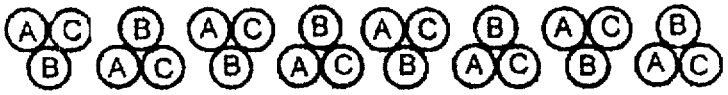
FIGS. 11*a* through 11*e* illustrate threading sequences for three colors supplied to each thread placement tool
Figure 11B:
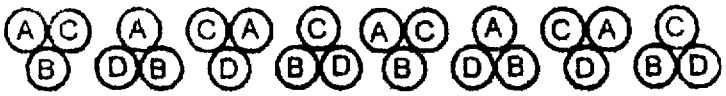
Figure 11C:
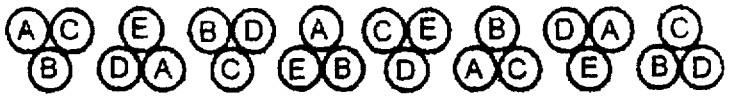
Figure 11D:
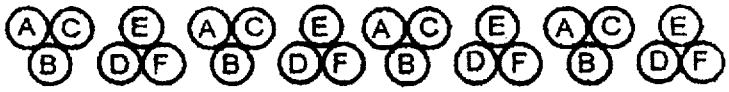
Figure 11E:
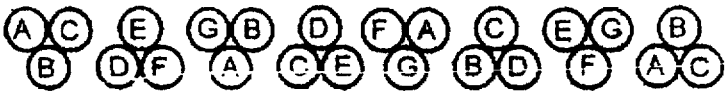

FIG. 11A shows a three color threading pattern for use with a CYP or other machine where A, B and C represent different colors as defined above. FIGS. 11B through 11E illustrate threading patterns for four, five, six and seven colors respectively, for placement according to the method of the invention as described more fully below.

FIG. 12A shows a two color threading pattern for two color needles in conventional operation of the CYP machine, or the more efficient modified machine adapted for practice of the invention.

FIGS. 12B through 12F illustrate threading sequences for three through seven colors with two color needles for practice of the invention. The reader should recall that the term needle is simply an alternative expression to thread placement tool and is used interchangeably with thread placement tool or hollow tube backing opener.

Figure 13:
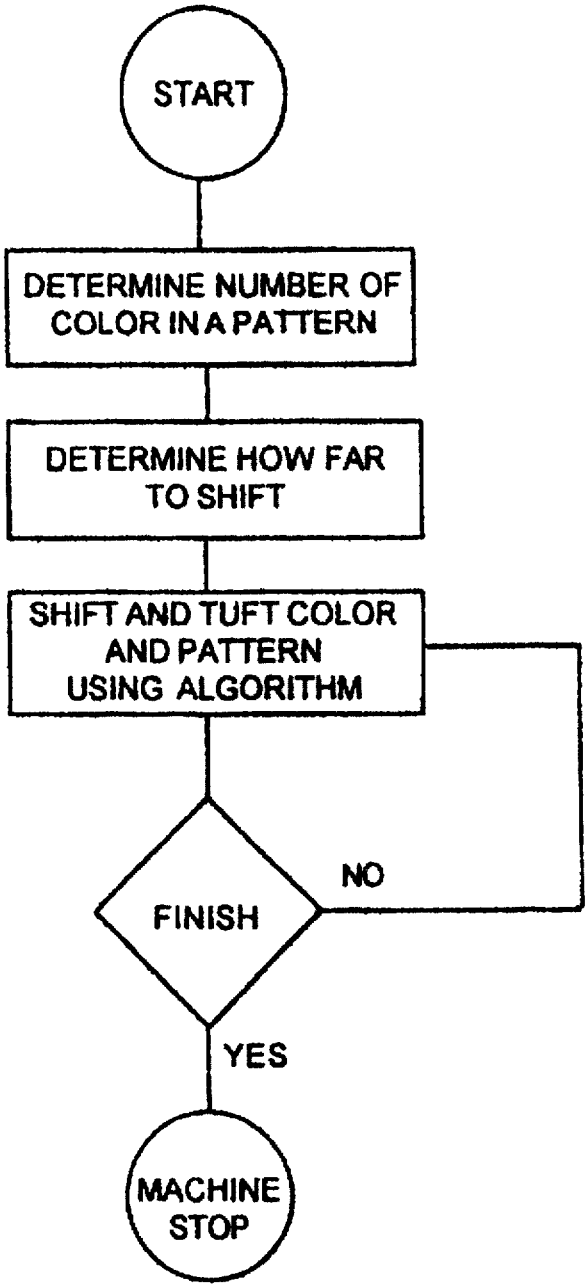
FIG. 13 is a flow chart schematically illustrating the steps of pattern production using the method of the invention.

Referring to FIG. 13, a flow chart illustrates the steps of the method in schematic form. To practice the method, one determines the number of colors in a particular pattern, determines how many shifts will be required to bring all colors to each location and implements the required shifting and tufting steps to produce the pattern, using lateral shifting to bring multiple needles past each location thereby supplying all colors at each location (without having all colors available at each location as in the prior art). One then checks the pattern for completion. If finished the machine stops; if not, the steps for shifting and tufting the colors according to the invention algorithm are repeated.

Instruction Set

FIG. 14 illustrates a simple three color pattern which may be produced with a CYP machine. The example illustrates a six gauge pattern to be placed with two color needles on one half inch centers. The current CYP machine requires 12 shifts with its needles on two inch centers to produce a row of tufting. In contrast, the improved machine using two colors per placement tool on one half inch centers needs at most only five shifts per row, and will sometimes need less. At equal operating speeds, the improved production is a 240% increase over the currently available CYP machine, quickly compensating for the longer setup time requires to supply thread to four times as many thread placement tools. The four fold increase in number of thread placement tools is further offset by reducing the number of threads supplied at each needle from six to two, somewhat reducing the additional set-up time required to rig the machine. FIG. 15 illustrates the implementation of the algorithm at each shift. The top row in each of FIGS. 15A–15G illustrate the pattern row being produced. The second and third rows from the top illustrate the colors available at each thread placement tool arranged as in FIG. 12B, the simplest case for illustrating the invention. The next to the bottom row specifies the thread being placed at the particular location on the shift cycle and the bottom row illustrates the growing row of the pattern as tufts are cumulatively placed at each location. An illustrative set of method steps for implementation of the invention are as follows:

1. The instruction set is supplied to the machine control system, preferably a computer, and especially preferred is a Berkeley Motion Controller Model No. BA-832 Hyperturbo manufactured by Berkeley Process Control, Inc. of Richland, Calif., which is a programmable computer having a separate processor for each motor, as for example the instructions for tufting the three color pattern of FIG. 14.

2. The desired gauge is set, as for example six stitches per inch in the example and the gauge information supplied to the instruction set.

3. The number of shifts are determined to bring each color to each location as the tufting progresses across the pattern. For the example, five shifts are required, as shown in table 1.

4. Initialize the tufting machine for the new pattern, resetting the servo motors, relays and position reporting encoders.

5. Load the instruction set and data and calculate the first row pattern into the system and order thread selections for all locations having the necessary color selection. In the example, two locations match as shown in the second row from the top of FIG. 15A. The tufting machine is supplied appropriate instructions to select the colors matching the pattern and to place only those threads and the machine is operated for one complete cycle.

6. The position is shifted one increment to the right and again the available colors are matched to the pattern, again two match as shown in 15B. The appropriate instructions are supplied to implement thread color selection for the two matches and only these threads are placed on the next machine cycle.

7. Again the position is shifted, and the available colors compared to the pattern and selected as shown in FIG. 15C. The process is repeated with available colors being placed until the position of 15D is reached.

8. Note that in the position of 15D several thread placement tools are for the first time positioned at locations wherein threads have already been placed on previous cycles. In the 15D position, the backing is preferably advanced a small amount, just enough for the thread placement tools to miss the already placed threads. Placement continues as in previous steps to the position of 15F, representing the fifth shift (sixth position) which completes the pattern.

9. The backing is now advanced one increment vertically and placement of the next pattern row is begun as illustrated in FIG. 15G with the mechanical steps for each thread placement cycle being implemented as explained above and controlled by an instruction set to implement the method of the invention, as described above, except that the shifting for this row is to the left.

Note that only five shifts are required to complete the pattern and with the closer spacing of the needles the threads are placed in each row more quickly even though every thread placement tool does not place a thread at each thread location on each cycle as is the case for the prior art machine, unless the pattern calls for a blank space. In the prior art operation, the shifting increment never exceeds the distance between thread placement tools, where in the method of the invention several shifts beyond the spacing of the thread placement tools as is shown in tables 1 and 2. The small incremental advance at the position of 15D can be eliminated on machines wherein the individual thread placement tools can be withdrawn to prevent penetrating the site of previously placed threads.

Figure 15D:
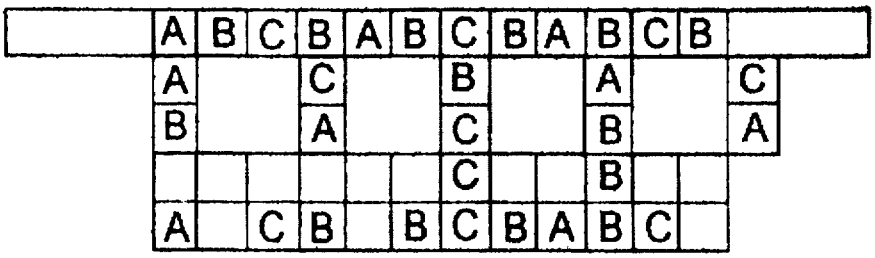
Figure 15E:
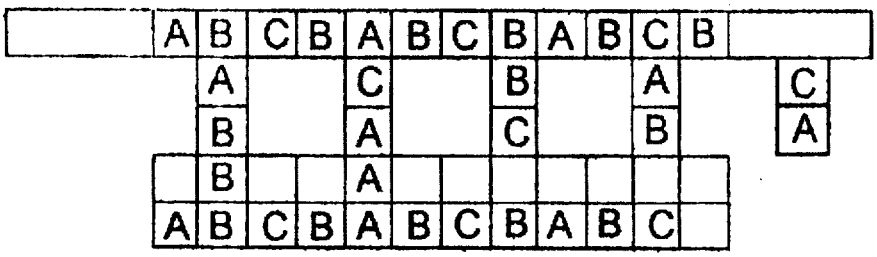
Figure 15F:
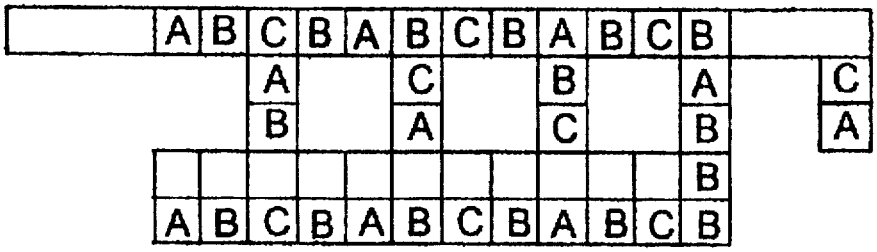
Figure 15G:
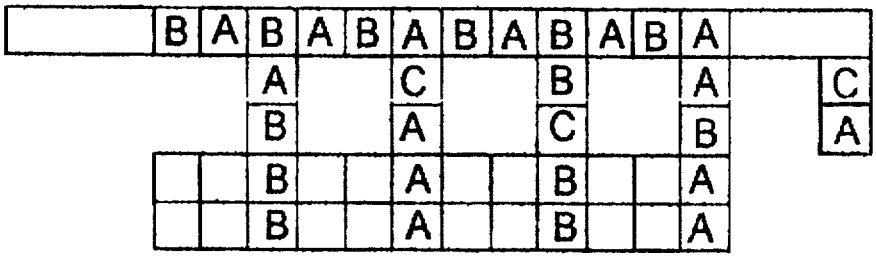

As noted above, in the prior art machine no operations analogous to the placement steps after FIG. 15D occur because each thread placement tool in the prior art method either placed a thread or left a blank on each stroke and moved on. On no occasion was the needle bar or backing shifted to bring an additional thread placement tool to the same location for a second placement as is shown in FIGS. 15D, 15E and 15F. Even though multiple needles reach the same relative location, the increased number of needles possible gives greater speed to the method of the invention. For the operation of a conventional CYP machine, the method of the invention greatly increases the number of colors that can be placed with a six color machine allowing configurations with any number of colors although with some decreases in operating speed with increases in number of colors.

For example, a conventional six color per needle machine can produce a twelve color pattern on a four inch center by providing a first six colors at the odd numbered locations and a second six colors at even numbered positions. The thread placement steps for a twelve color pattern are exactly the same except that the number of color choices at each needle is greater, however the number of shifts is the same as for that shown for a four color pattern on a two color needle set. In like manner, any number of thread colors and threads per needle can be handled to obtain either greater speed on simpler patterns or greater variety of colors from conventional CYP machines and other tufting machines of similar capability.

From the foregoing it will be appreciated that the invention may be used with any combination of threads of different color, size, character or type, and affords remarkable flexibility in the implantation of the different threads into a backing, thereby enabling the production of tufted goods embodying patterns or designs heretofore unavailable except by printing or with woven goods produced on a loom, and an improvement over the methods heretofore available. Moreover, the invention affords significant advantages over other known apparatus and methods in its ability to produce carved or sculptured patterns, as by omitting tufts in selected areas, or by varying the spacings between tufts. Also, the invention enables goods having a varying density to be readily produced.

Numerous alterations of the structure herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the spirit of the invention are intended to be included within the scope of the appended claims.

I claim:

1. In a machine for placing a plurality of colors of threads into a backing web to form a desired pattern having (a) a plurality of thread placement tools for placing a selected thread color from a plurality of thread color supply sources into the backing web; (b) a control means responsive to an instruction set for carrying out sequential operations to produce a desired pattern; (c) means for accurately relatively positioning the thread placement tools relative to the backing web in response to commands from said control means and (d) means for selective placement of said thread colors into said backing web in response to commands from said control means, a method for placing said thread colors into said backing web to form said desired pattern comprising the steps of:

supplying at least two thread colors to a first thread placement tool and supplying at least one color different from the colors supplied to the first thread placement tool to a second thread placement tool, each of said first and second placement tools being positionable relative to an overlapping region of said backing web and being supplied fewer than the total number of colors to be used within the overlapping region of the backing web;

relatively positioning said first tool at a selected location with respect to said backing web and within said overlapping region in response to commands from said control means;

placing said selected one or more thread colors into said backing web at said selected location in response to commands from said control means;

relatively positioning said second tool with respect to said backing web over a selected location on said backing web within the overlapping region which requires a thread color available from said second tool but not said first tool; and placing selected one or more of the thread colors supplied to said second thread placement tool into said backing web at said selected location in said overlapping region in response to commands from said control means.

2. A method according to claim 1 wherein the thread placement tool is a tubular backing opener.

3. A method according to claim 2 wherein the thread ends are pneumatically conveyed from the thread end supply source to the thread placement tool.

4. A method according to claim 1 wherein the means for changing the relative positions of the thread placement tools in relationship to the backing web includes means for moving the backing web in a transverse direction relative to the thread placement tools.

5. A method according to claim 3 wherein the means for changing the relative positions of the thread placement tools in relationship to the backing web includes means for moving the backing web in a transverse direction relative to the thread placement tools.

6. A method according to claim 1 wherein the means for changing the relative positions of the thread placement tools in relationship to the backing web includes means for moving the thread placement tools in a transverse direction relative to the backing web.

7. A method according to claim 3 wherein the means for changing the relative positions of the thread placement tools in relationship to the backing web includes means for moving the thread placement tools in a transverse direction relative to the backing web.

8. A method according to claim 3 wherein the thread end supply source includes a thread pull back means.

9. A method according to claim 5 wherein the thread end supply source includes a thread pull back means.

10. A method according to claim 7 wherein the thread end supply source includes a thread pull back means.

11. A method according to claim 1 wherein each thread placement tool is supplied two thread ends.

12. A method according to claim i wherein each thread placement tool is supplied three thread ends.

13. A method according to claim 1 wherein the relative distance between thread placement tools and number of shifts required for complete availability of all colors at each particular location is determined from table 1 or table 2.

14. A method according to claim 1 wherein the threading sequence for the colors available at each thread placement tool at each location is as shown in a figure selected from the group consisting of FIGS. **11*b* through 11E and FIGS. 12A through 12F**.

15. A machine for producing a pattern on a backing web comprising: (1) a plurality of thread placement tools, each capable of placing a selected thread end from a plurality of thread end supply sources into the backing web; (2) a control means responsive to an instruction set for carrying out sequential operations to produce a desired pattern; (3) means for accurately positioning the thread placement tools relative to the backing; and (4) means for changing the relative positions of the thread placement tools in relationship to the backing web to place threads at multiple relative locations on the backing web; (5) means for supplying an instruction set to produce a multicolor pattern requiring at least three different colors, to be produced; (6) a threading sequence which includes the plurality of thread end supply sources for a first thread placement tool including at least two thread end colors and the plurality of thread end supply sources for a second thread placement tool including at least one thread end color different than the colors supplied to the first thread placement tool; (7) the thread placement tool spacing being established by the instruction set, and means for implementing transverse position shifts to produce the desired pattern by placing the selected thread color ends to be supplied to each thread placement tool such that each thread placement tool is supplied fewer than the total number of colors to be used in the pattern and the pattern is completed by shifting thread placement tool locations to supply additional colors to complete the selected pattern when a selected color is not available at a particular location in a first thread tool placement position and the unavailable desired thread color is available at a second thread placement tool position which is shifted to supply the desired thread at the particular location and the second thread placement tool selectively supplies the desired color.

16. An instruction set embodied in a medium for practice of the method of claim 1.

17. An instruction set to be supplied to a tufting machine control system in a tufting machine for placing a plurality of colors of threads into a backing web to form a desired pattern having (a) a plurality of thread placement tools for placing a selected thread color from a plurality of thread color supply sources into the backing web; (b) a control means responsive to an instruction set for carrying out sequential operations to produce a desired pattern; (c) means for accurately relatively positioning the thread placement tools relative to the backing web in response to commands from said control means and (d) means for selective placement of said thread colors into said backing web in response to commands from said control means, that comprises codes for establishing a desired gauge; computing a number of shifts required to bring each pattern color to a desired location; codes for initializing the tufting machine; codes for resetting servo motors, relays and position encoders; codes for loading data to calculate a row pattern into a system; codes to order thread selections for all locations having a color selection and codes to select the thread colors matching the pattern and codes to place only selected threads when the machine is operated for one complete cycle; codes for advancing the machine one increment in a first direction and placing selected colors to the pattern; codes for supplying instructions for positioning a second thread placement tool at a position wherein a thread has already been placed on a previous cycle at some locations and supplying a color not available to the first thread placement tool at a location by a thread placed by the second thread placement tool.

18. An instruction set according to claim 17 which further comprises codes for advancing the backing a small amount, such that the thread placement tools miss the already placed threads when a second placement tool is positioned at a location wherein a thread has already been placed.

* * * * *